US009435595B2

(12) United States Patent
Azhocar

(10) Patent No.: US 9,435,595 B2
(45) Date of Patent: Sep. 6, 2016

(54) TACTICAL TAKEDOWN ASSIST TOOL

(71) Applicant: Frederick Steven Azhocar, San Diego, CA (US)

(72) Inventor: Frederick Steven Azhocar, San Diego, CA (US)

( * ) Notice: Subject to any disclaimer, the term of this patent is extended or adjusted under 35 U.S.C. 154(b) by 0 days.

(21) Appl. No.: 14/658,186

(22) Filed: Mar. 14, 2015

(65) Prior Publication Data

US 2015/0260471 A1 Sep. 17, 2015

Related U.S. Application Data

(60) Provisional application No. 61/953,502, filed on Mar. 14, 2014, provisional application No. 62/056,417, filed on Sep. 26, 2014.

(51) Int. Cl.

| | |
|---|---|
| ***F41A 11/04*** | (2006.01) |
| ***F41C 27/00*** | (2006.01) |
| ***F41A 11/00*** | (2006.01) |
| ***F41A 35/00*** | (2006.01) |
| ***F41C 23/02*** | (2006.01) |

(52) U.S. Cl.

CPC ..... *F41A 11/00* (2013.01); *F41A 35/00* (2013.01); *F41C 23/02* (2013.01)

(58) Field of Classification Search

CPC ..... F41A 11/00; F41A 11/02; F41A 11/04; F41A 35/00; F41C 23/02; F41C 27/00

USPC ..... 42/108, 75.03, 85

See application file for complete search history.

(56) References Cited

U.S. PATENT DOCUMENTS

| | | | | | |
|---|---|---|---|---|---|
| 2,763,082 | A * | 9/1956 | Sprague | F41C 23/02 | 42/85 |
| 3,066,375 | A * | 12/1962 | Knowles | F41C 23/02 | 24/639 |
| 3,861,070 | A * | 1/1975 | Wild | F41C 23/16 | 42/85 |
| 4,648,191 | A * | 3/1987 | Goff | F41A 11/00 | 42/75.02 |
| 5,692,654 | A * | 12/1997 | Bell | F41C 23/02 | 224/150 |
| 5,848,491 | A * | 12/1998 | Biemont | B23B 47/28 | 42/106 |
| 5,916,340 | A * | 6/1999 | Forsyth | B25B 23/12 | 81/124.6 |
| 6,115,952 | A * | 9/2000 | Rigler | F41C 27/00 | 362/110 |
| 6,173,519 | B1 * | 1/2001 | Garrett | F41A 17/38 | 42/70.01 |
| 6,325,258 | B1 * | 12/2001 | Verdugo | F41C 33/001 | 224/149 |
| 6,354,034 | B1 * | 3/2002 | Norris, Sr. | F41C 23/02 | 42/85 |

(Continued)

*Primary Examiner* — Bret Hayes
*Assistant Examiner* — Derrick Morgan
(74) *Attorney, Agent, or Firm* — Kevin Keener; Keener and Associates P.C.

(57) ABSTRACT

The invention is directed toward a magnetized takedown tool for removing pins from an assault rifle. The magnetic element of the magnetized takedown tool allows the tool to be removably secured to an assault rifle. In addition, the invention is directed toward a docking unit which may be removably secured to the assault rifle and to which the magnetized takedown tool can be removably secured during use.

10 Claims, 20 Drawing Sheets

(56) References Cited

U.S. PATENT DOCUMENTS 6,955,279 B1 * 10/2005 Mudd ..... A45F 5/02 224/197
7,357,225 B2 * 4/2008 Dorian ..... F01M 11/0408 123/196 R
7,654,027 B1 * 2/2010 Grover ..... F16B 21/165 24/573.11
D636,836 S 4/2011 Fitzpatrick et al.
8,069,606 B1 * 12/2011 Saur ..... F41A 11/00 29/278
8,087,194 B1 1/2012 Vuksanovich
8,166,694 B2 * 5/2012 Swan ..... F41C 33/007 224/198
8,276,304 B2 10/2012 Samson
8,307,578 B1 * 11/2012 Azhocar ..... F41A 17/38 42/108
8,312,662 B2 11/2012 Rogers et al.
8,333,137 B2 12/2012 Sirochman
8,635,799 B2 1/2014 Azhocar
8,850,738 B2 * 10/2014 Silver ..... F41C 27/00 42/1.05
2003/0141329 A1 * 7/2003 Huang ..... A45F 5/02 224/197
2004/0020092 A1 * 2/2004 Christensen ..... F41A 9/70 42/49.01
2005/0034347 A1 * 2/2005 Verdugo ..... F41C 23/02 42/85
2006/0254113 A1 * 11/2006 Esch ..... F41C 23/02 42/85
2009/0199345 A1 * 8/2009 Morgan ..... B25F 1/04 7/118
2010/0287808 A1 * 11/2010 King ..... F41C 23/02 42/85
2011/0138671 A1 * 6/2011 Rogers ..... F41C 23/02 42/85
2014/0237877 A1 * 8/2014 Silver ..... F41A 17/44 42/70.11
2014/0298703 A1 * 10/2014 Gale ..... F41C 27/00 42/71.02
2015/0013202 A1 * 1/2015 Hendricks ..... F42B 5/025 42/51

* cited by examiner

TACTICAL TAKEDOWN ASSIST TOOL

PRIORITY

This application claims the benefit of U.S. Provisional Application No. 61/953,502, filed Mar. 14, 2014 and U.S. Provisional Application No. 62/056,417, filed Sep. 26, 2014.

FIELD OF INVENTION

This invention relates to semi-automatic firearms such as the M-16/AR-15 rifle type; and more specifically, disclosed herein are tactical assist tools for use with semi-automatic firearms. In particular, a magnetized assembly for quick and easy takedown of a rifle is provided. In particular embodiments, the assembly includes attachment points for additional devices such as slings and the like.

BACKGROUND OF INVENTION

A rifle that can be taken apart so that its length is reduced by about half is easier to travel with, store, and pack. There are at least two types of takedown rifles: "incidental" takedowns and "intentional" takedowns. In the case of incidental takedowns, the fact that these rifles can be taken down and conveniently cased is quite incidental—accidental even—to the intent of their original design. Examples of incidental takedowns can include break-action, double-barreled rifles. Their design intent was to provide simple and reliable operation. The fact that their barrels are easily removed from the action is an incidental feature of the firearm. Also included in this category are more modern concepts such as the Blaser rifle, which in addition to being a novel bolt-action variation features a relatively fast and simple barrel-removal and caliber-switching arrangement. By loosening a couple of screws, the barrel can be separated from the action and stock and the two separated units can be packed and carried with relative convenience. This "takedown" capability, however, is merely incidental to the Blaser's original barrel-switch concept.

In the case of "intentional" takedowns, these firearms are expressly designed so they could be quickly taken apart for compact carry or modified from a traditional design for takedown convenience. Intentional takedowns can include lever rifles that were originally designed as rigid, full-length models but were subsequently redesigned so that the barrel, tube magazine and forearm could be quickly removed from the receiver as well as more modern firearm models, as will be described in greater detail below.

The way these rifles come apart is usually with the threaded breech of the barrel being screwed out of and into the matching receiver and locked in place by a latch or other mechanism. Some models feature an interrupted thread arrangement, which allows the barrel to be quickly inserted into the receiver, given a half twist and locked in place. Typically, these lever-action takedowns are fitted and aligned and have mechanisms for locking the barrel securely in place.

In recent years, the preference is for bolt-action rifles in increasingly powerful calibers. This has complicated the takedown issue in several ways. A bolt-action takedown rifle can be of a simple barrel-unscrewing design, and many of them are. In fact, during WWII the Japanese made just such a takedown modification to their Arisaka Type 99 bolt rifle for use by their paratroopers. Some firearm manufacturers have replaced the traditional threaded barrel attachment with a non-threaded sleeve-like fit, in which the shank of the barrel slips into a tightly dimensioned hole in the front of the receiver. Takedown tools have been developed which facilitate disassembly of a rifle. Exemplary takedown tools include the Gunsmither Takedown Tool, the Kimber Takedown Tool, the PinnPrecision AR-15 pivot and the takedown pin pusher tool.

However, basic problems continue to plague these takedown tools. In practice, carrying a separate takedown assist tool in the field can present numerous challenges such as fumbling around while trying to pop the take down or pivot pin out. In operation, conventional takedown tools are often cumbersome to negotiate while carrying a rifle and are nearly impossible to implement one handed. Moreover, certain prior art takedown devices are tight and difficult to disengage, forcing the user to exert additional force disengage the pin, risking injury to the user and/or firearm.

There remains a need for takedown assist tools which allow for the quick release of the takedown bolts while providing ease of access to the user and minimizing damage to the firearm.

SUMMARY OF INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

Disclosed is a takedown assist assembly for use in breaking down a takedown rifle. The assembly may include a magnetic takedown tool and a docking station. The docking station comprises a recessed portion configured to seat the takedown tool. The takedown tool is in magnetic communication with the recessed portion of the docking station and removeably attached to the docking station via a magnetic attraction.

Optionally, the assembly may be configured for placement between the buttstock and endplate of a takedown rifle. Alternatively, the assembly may be configured for placement on a Picatinny rail.

In another aspect of the invention, the docking station may include a securing member.

In yet another aspect, the docking station may further include a magnet positioned in the recessed portion of the docking station. The takedown tool is preferably dimensioned to release a plurality of takedown pins on the rifle.

The invention is directed toward a magnetic takedown tool for removing pins from a takedown rifle. The magnetic takedown tool comprises a head portion and a body portion. The head portion has a first side and a second side opposite the second side, the first side and the second side forming a peripheral edge located between the first side and the second side. The peripheral edge contains one or more recessed tracks. Each of the one or more recessed tracks are configured to receive one or more securing elements. The body portion is connected to the second side of the head portion. The body portion is substantially cylindrical in shape. The longitudinal axis of body portion extends substantially perpendicular from the head portion. The body portion comprises a magnetic element. In another embodiment the second side of the head portion contains one or more recesses configured to permit one or more securing elements to access the one or more recessed tracks. In another embodiment the magnetic element is substantially cylindrical in shape. The longitudinal axis of the magnetic element is in substantial alignment with the longitudinal axis of the body portion. The magnetic element is connected to the body portion. In another embodiment the head portion further comprises a magnetic material.

The invention is also directed toward a firearm assembly for use in breaking down a takedown rifle. The firearm assembly comprises a magnetized takedown tool as described above and a docking station. The docking station comprises one or more securing elements and a recessed area. The docking station is configured to be removably secured to a takedown rifle. The magnetized takedown tool can be removably secured to the docking station by placing the body portion of the magnetized takedown tool within the recessed area of the docking station and positioning the one or more securing elements of the docking station within the one or more recessed tracks of the magnetized takedown tool. In another embodiment the docking station further comprises a magnetic element positioned within the recessed area of the docking station.

In another embodiment of the invention the assembly further comprises one or more swivels. The one or more swivels comprise a sling attachment, shaft connected to the sling attachment, and one or more bearings positioned at the base of the shaft. In this embodiment the docking station further comprises one or more receptacles. Each of the one or more receptacles define an internal opening for receiving the shaft of the sling swivel. The internal opening comprises one or more receptacle recesses for receiving the one or more bearings on the sling swivel.

In another embodiment the docking station further comprises a central opening defining a space to receive a buffer tube of a firearm. Optionally, in another embodiment, the docking station comprises an upper portion and a lower portion. The upper portion and the lower portion may be removably secured together. When the upper portion is removably secured to the lower portion, the upper portion and the lower portion define a central opening defining a space to receive a buffer tube of a firearm.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims. After reading this description it will become apparent to one skilled in the art how to implement the invention in various alternative embodiments and alternative applications. However, all the various embodiments of the present invention will not be described herein. It is understood that the embodiments presented here are presented by way of an example only, and not limitation. As such, this detailed description of various alternative embodiments should not be construed to limit the scope or breadth of the present invention as set forth below.

Provided herein is a takedown assist tool and docking station assembly for use with a takedown gun such as a fully automatic or semi-automatic rifle or other firearm. A takedown gun refers to a long gun designed to be taken apart to reduce its length, thereby making the gun easier to store, pack, transport, breakdown for cleaning and/or repair, and/or conceal. Thus, "takedown" refers to the process by which components of a firearm can be readily taken apart. As used herein, the term "firearm" is intended to have the broadest possible meaning and includes but is not limited to any of various automatic or semiautomatic rifles, for example, AR-15, a M16, the Soviet Kalashnikov (the AK-47 and modernized versions), the Belgian FAL and FNC, Bushmaster ACR, FNH Scar, and the German G3. In a particularly preferred embodiment, firearm refers to an AR-15 semi-automatic assault rifle. The docking station may further include attachment points for additional devices such as slings and the like. Further, the docking station may be formed in multiple parts to allow the docking station to be assembled with one or more fasteners around a portion of the firearm such as a castle nut.

Figure 1A:
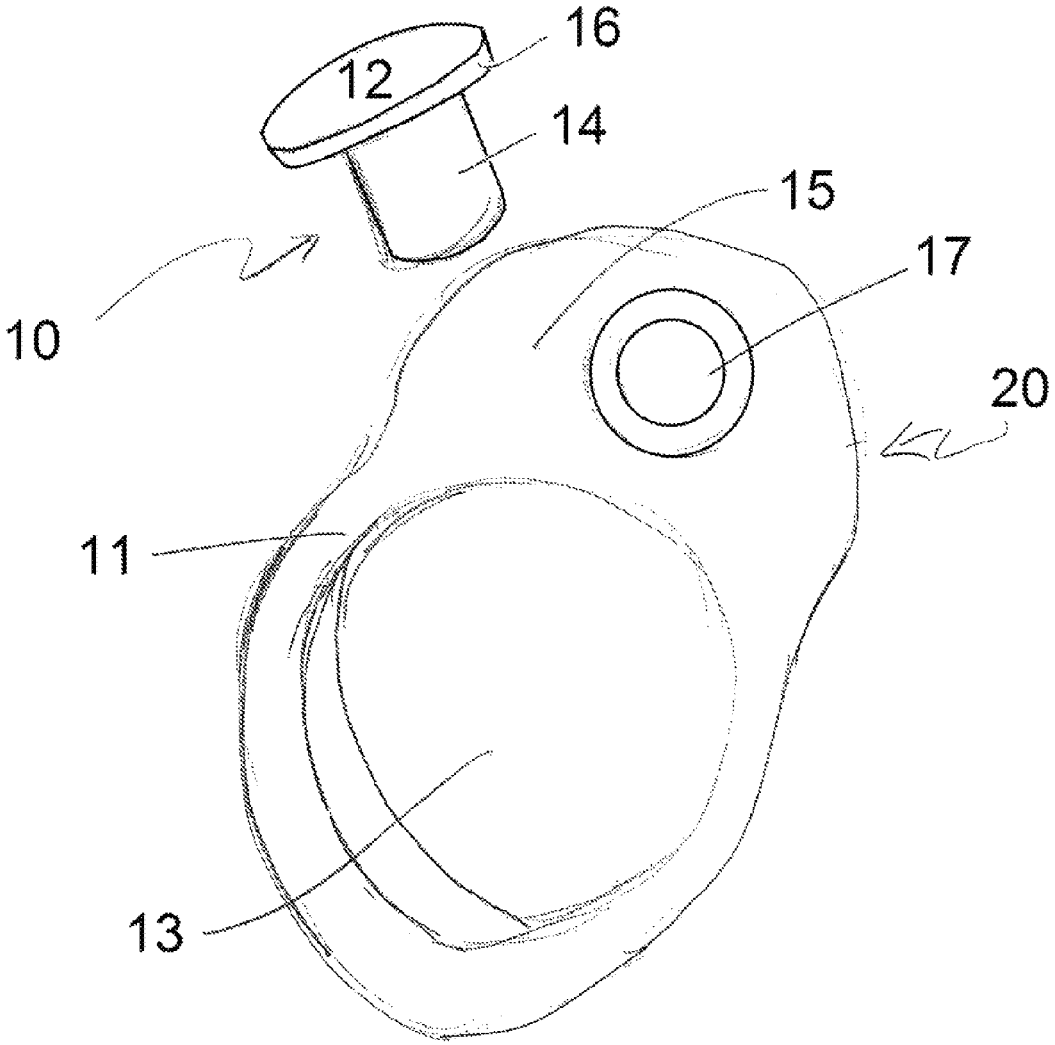
FIG. 1A is a perspective view of a takedown assist tool disengaged from a docking station.
Figure 1B:
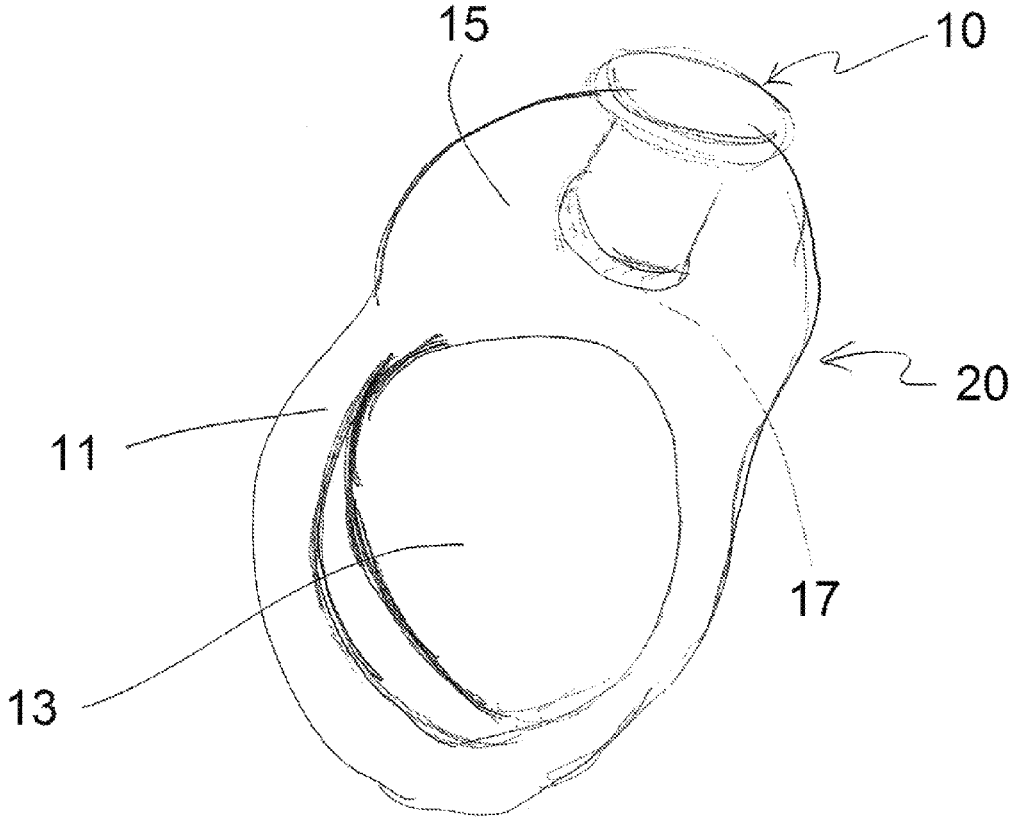
FIG. 1B is a perspective view of a takedown assist tool engaged and in magnetic communication with the dockings station.

An embodiment of the takedown assist tool and docking station are illustrated in FIGS. 1A and 1B. FIG. 1A is a perspective view of a takedown assist tool 10 disengaged from a docking station 20, whereas FIG. 1B is a perspective view of a takedown assist tool 10 seated in the docking station 20. The tool 10 is similar to the magnetic insertion pin described in U.S. Pat. Nos. 8,307,578 and 8,635,799, the contents of which are hereby incorporated by reference in their entireties. The tool 10 comprises a head portion 12 and a body portion 14. Disposed within the body portion 14 is the magnetic element. The magnetic element can be pressure fitted to the body portion 14, affixed by an epoxy, slip fitted, or otherwise adhere to the center core of the body portion. The magnetic element is preferably constructed from a powerful rare-earth magnetic material 'neodymium', which is metal-like in appearance, and as such serves to aid the seating of the tool into the center recess (not shown but described in detail below) of the docking station. The head portion 12 comprises an annular flange 16 extending beyond the body portion 14. In operation, the flange 16 provides a lip to facilitate grasping and/or removing of the tool 10 from the docking station 20 and insertion of the tool 10 into the takedown pins of a rifle. Though not illustrated, it will be appreciated that the head portion 12 can optionally include a layer of plastic, rubber, texture, or other suitable material to provide added grip to the head portion 12. The takedown tool 10 is dimensioned to fit within the takedown pins of a rifle. In some embodiments, the takedown tool 10 has a radius of between about ⅛" and ¼".

As illustrated in FIG. 1B, the tool is self-sustaining in place relative to the docking station by virtue of the magnetic communication between the tool and the docking station. Preferably, the docking station is fabricated from a metal which is attractive to the neodymium material of the takedown tool. It will be appreciated, however, that the docking station and/or takedown tool can be made of a hard polymer plastic. When constructed of a hard polymer plastic, the takedown tool and docking station are threaded such that the takedown tool and docking station self-lock to secure the takedown tool to the docking station. Portions of the exterior of the takedown tool thread outwardly and can be positioned within the recessed portion of the docking station, which is likewise threaded. The tool can be secured to the docking station by screwing the tool into the recessed threaded portion of the docking station. When the tool is screwed into the recessed threaded portion of the docking station, the tool need not be magnetized. Instead, it can be constructed of any suitable metal and/or hard polymer plastic and can seat in the docking station by merit of the threaded engagement.

As will be described in greater detail below, the tool and docking station assembly can be positioned on a firearm such that the takedown tool is removably attached to the docking station 20 and provides easy access to the user for quick takedown of the firearm. The docking station 20 generally comprises a main fitting body 11 having a shape configured to allow passage of a receiver extension of a firearm through the shape. As illustrated in FIGS. 1A and 1B, the main fitting body has an ovular shape with a portion of the main body defining an aperture 13 through which a receiver extension will slide when the docking station 20 is installed on a firearm and a wider portion 15 providing a docking area for a takedown tool 10. As illustrated in FIGS. 1A and 1B, the docking area can include a recessed area 17 dimensioned to seat the takedown tool 10 on the surface of the docking area.

Figures 2A, 2B:
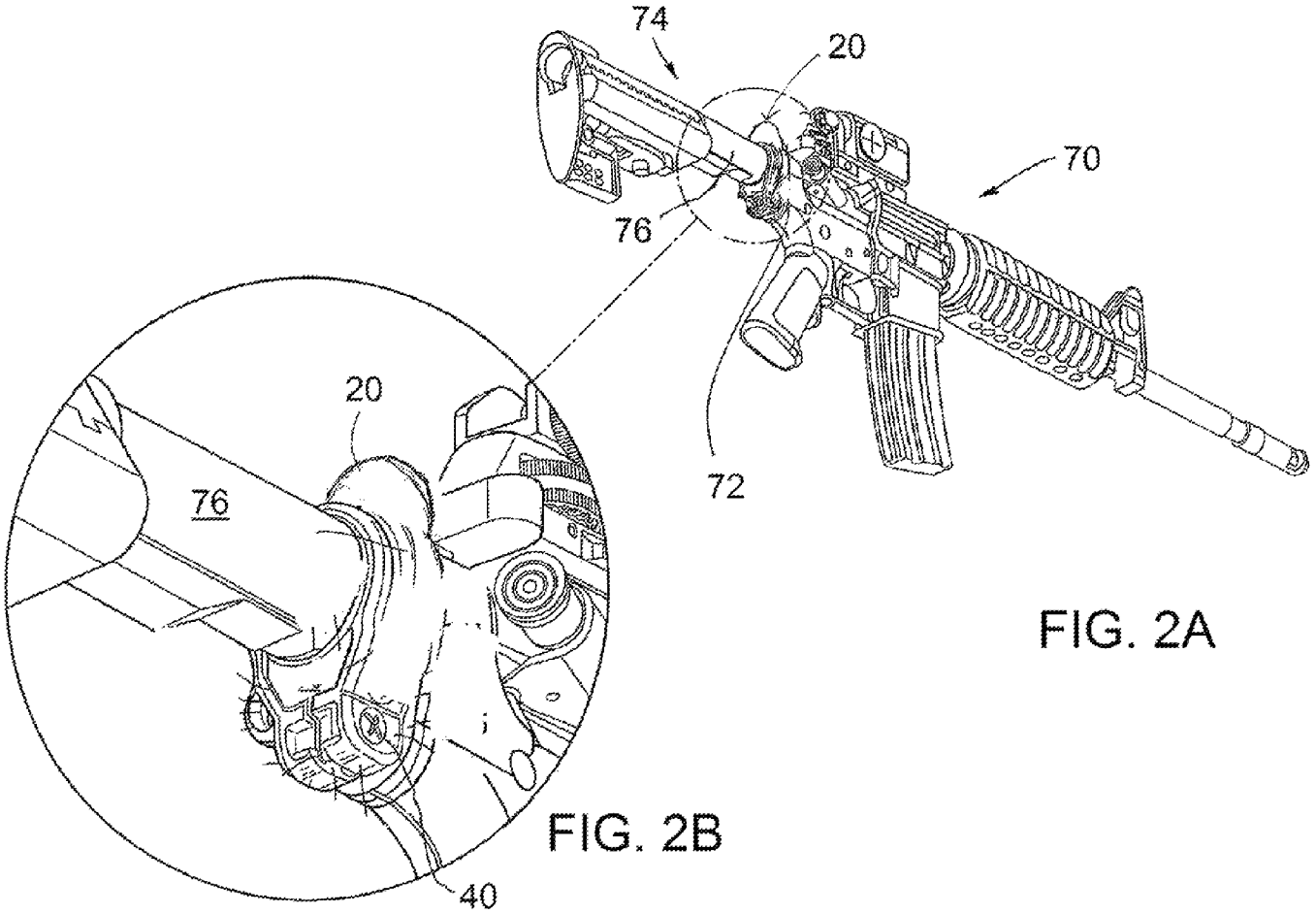
FIG. 2A is a rear perspective view of a takedown tool and docking station assembly installed on a rifle.
FIG. 2B is a detail view of the indicated portion of FIG. 2A.

In certain aspects, the tool 10 and docking station 20 assembly are incorporated into the design and manufacture of a rifle and are not intended to be removed from the firearm. In other aspects, the tool and docking station assembly can be retrofitted to existing firearms without gunsmithing much in the same way as rifle sling adapters can be retrofitted to a firearm. As seen in FIGS. 2A and 2B, generally, the docking station 20 is secured to the rifle near the rifle's receiver. FIG. 2A is a rear perspective view of a takedown tool and docking station assembly installed on a rifle 70. FIG. 2B is a detail view of the indicated portion of FIG. 2A. As illustrated, the tool (not shown) and docking station 20 assembly attach to the rifle 70 near or adjacent the rifle's end plate 72, between the buttstock assembly 74 and the buffer tube 76. To secure the docking station to a rifle 70, a telestock (also called the stock body) of the buttstock assembly 74 can be removed so that the docking station 20 can be slid over a receiver extension or buffer tube to a point near or adjacent the rifle's end plate 72. The docking assembly is then secured to the buffer tube there, generally by tightening a fastener 40 as will be described with reference to FIGS. 3 and 4. While the docking station and tool assembly are preferably attached to a firearm at the end plate, it will be appreciated that the tool and docking assembly can be affixed to other parts of a firearm to provide ease of access for takedown of the firearm. Other suitable locations can include on the buttstock of a firearm or on a Picatinny rail, as will be described in greater detail with reference to FIG. 6.

Figure 4:
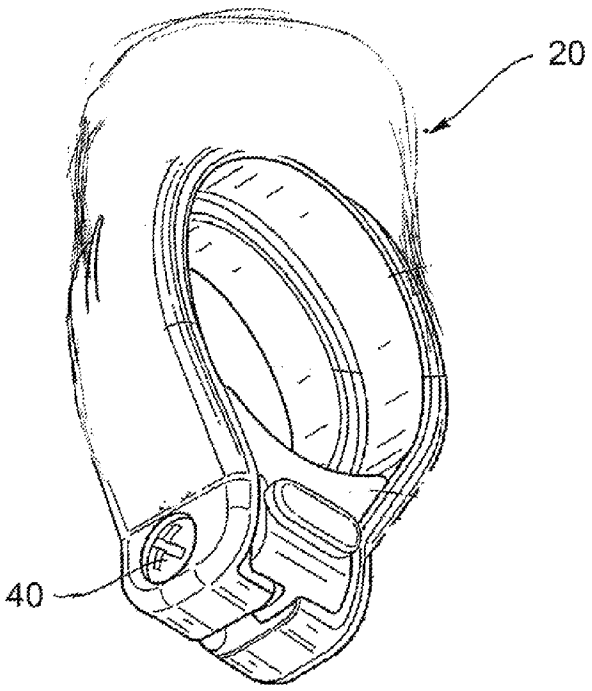
FIG. 4 is a bottom perspective view of the docking station of FIG. 3.
Figure 3:
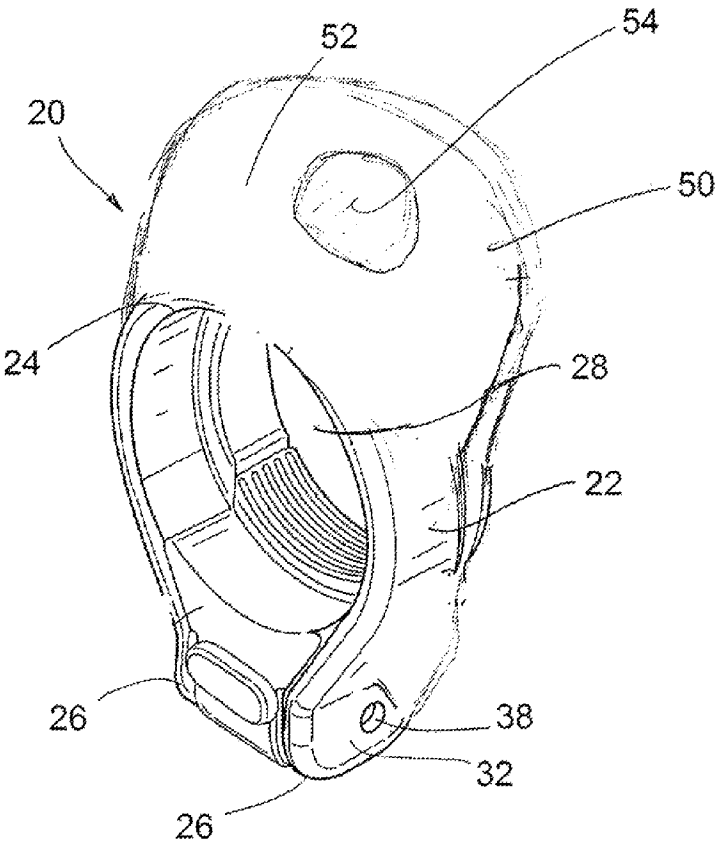
FIG. 3 a non-exploded top perspective view of a docking station of FIG. 1, also including a fastener element.

As illustrated in FIGS. 3 and 4, the docking station 20 comprises an adapter clamp 22 for use of the docking station with an existing firearm. FIG. 3 is a non-exploded top perspective view of a docking station of FIG. 1, also including a fastener element. FIG. 4 is a bottom perspective view of the docking station of FIG. 3. The docking station 20 is comprised of a ferromagnetic material which is in magnetic communication with the takedown assist tool 10. Suitable ferromagnetic materials for use in construction of the docking station include, without limitation, cobalt, nickel, and iron. Preferably, the docking station 20 is made of a metal such as steel or aluminum. The docking station can optionally include a magnet constructed of rare earth neodymium positioned in the recessed surface of the docking station to enhance the attraction of the takedown tool relative to the docking station and secure the tool.

The adapter clamp 22 comprises a collar 24 and a spaced pair opposing fastener housings 26. The collar 24 is principally a band formed in a generally elliptical shape so as to define a central opening 28. Generally, the central opening 28 is sized to receive the receiver extension of the buttstock assembly (as shown more clearly in FIG. 2) of a rifle. Opposing ends 32 of the collar 24 are spaced apart and bracket the pair of fastener housings 26. Each end 32 of the collar 24 is adjacent to an end of a respective fastener housing 26. At generally the locations where each end 32 of the collar 24 meets an end of the respective fastener housing 26, the collar 24 changes shape from gradually curved to substantially vertical. The ends of the collar 24 are aligned adjacent to, and formed integrally with, the substantially vertical ends 34 of the fastener housing 26.

An opening 38 of the clamp 22 passes through an end 32 of the collar 24 and on through a first fastener housing 26. The openings are aligned so that a fastener element 40 such as a screw, can be passed through the unthreaded opening 38 and into a threaded opening of the clamp 22. The fastener element 40 as shown in FIG. 4, passes through another end of the collar 24 and on through a second fastener housing 26. The openings 38, are aligned so that a fastener element 40 such as a screw can be passed through the unthreaded opening and into the threaded opening. In this way, the fastener element 40 is used to draw together the two ends 32 of the collar 24 to assist in securing the docking station to the receiver extension much in the same way as is described in U.S. Pat. No. 8,312,662, the entire contents of which are hereby incorporated by reference in their entirety.

Figure 5:
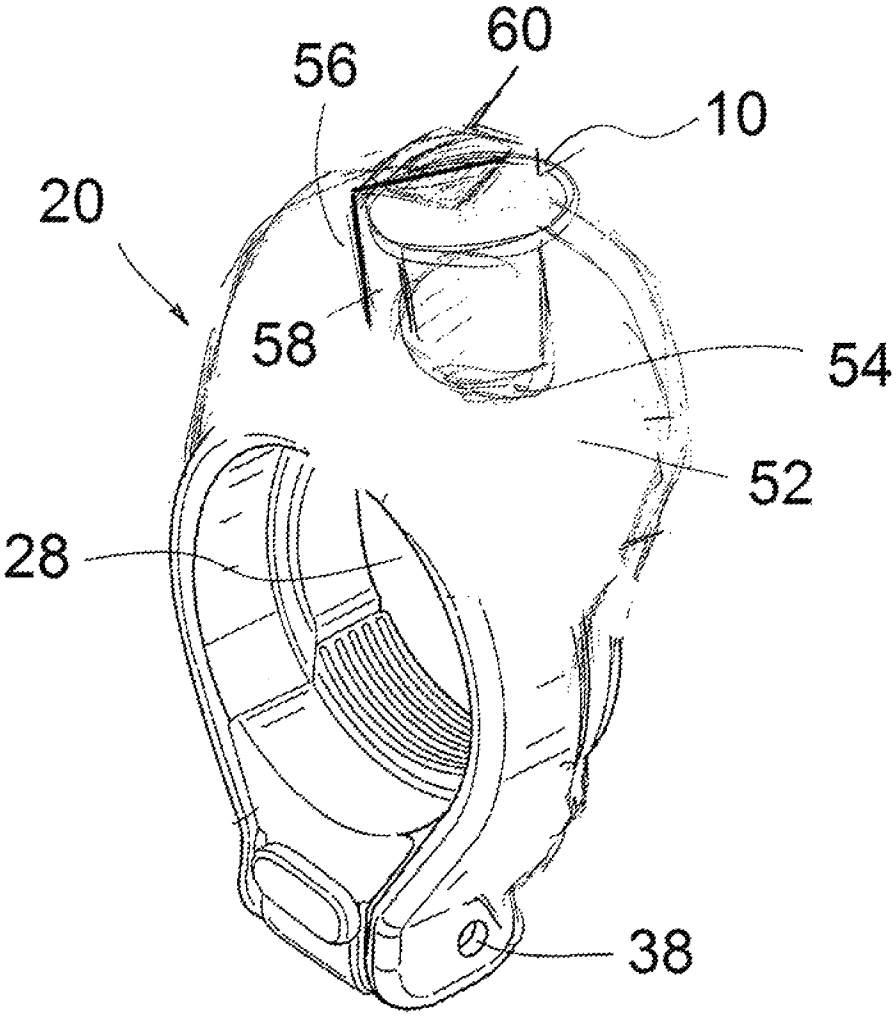
FIG. 5 is a non-exploded top perspective view of a docking station including the takedown assist tool seated in the recessed portion of the docking station.

On the exterior surface of the docking station 20, an elongated docking member 50 is integrally attached to the collar 24. The docking member 50 is comprised of a metal having magnetic properties. In one embodiment, the docking member is constructed from aluminum. In alternative embodiments, the docking member is fabricated from steel. The docking member 50 comprises a substantially flat portion 52 and a recessed portion 54. The recessed portion 54 can include a magnet (not shown) which enhances the attraction between the takedown tool 10 and the surface of the docking station 20 when the takedown tool 10 is seated in the recessed portion 54 of the docking station 20. As illustrated in FIG. 5, the takedown tool 10 fits within the recessed portion of the docking station securely when the tool is housed on the docking station 20. The magnetic properties of the takedown tool 10 are in magnetic communication with the ferromagnetic docking member.

Optionally, the docking station includes a securing element 56 which further secures the takedown tool 10 to the docking station 20. The securing element, as illustrated in FIG. 5, comprises a vertical element 58 and a horizontal element 60. The vertical element 58 extends upward at approximately a 90° angle relative to the recessed portion 54 of the docking station 20 and at a height slightly higher than the height of the takedown tool 10 when the takedown tool 10 is seated in the recessed portion 54 of the docking station 20. The top of the vertical element 58 is integrally attached to the horizontal element 60, which is substantially parallel to the recessed portion 54 of the docking station 20. In operation, in addition to the magnetic force that holds the takedown tool securely to the docking station, the takedown tool 10 can be placed in the recessed portion of the docking station and the base of the vertical element 58 further secures the tool 10 in place relative to the docking station 20. The horizontal element 60 is integrally attached to the upper portion of the vertical element 58 and is configured such that the takedown tool 10 can fit within the recessed portion 54 of the docking station 20 and underneath the extending arm of the horizontal element 60. The horizontal element 60 provides further protection from inadvertent dislodgement of the tool 10 if the firearm is dropped or otherwise disrupted by holding the takedown tool 10 in place. In particularly preferred embodiments, the docking member includes a grooved track for facilitating placement of the takedown tool in the recessed portion of the docking station. The track is dimensioned such that the takedown tool can slide into place relative to the securing member.

Because the docking station 20 is constructed from metals which attract a magnet, the takedown tool 10, which is constructed from magnetic material, attracts to the docking station 20 and the takedown tool 10 can thus be removeably attached to the docking station 20. In one aspect, the docking station 20 may also include magnetic material at the recessed portion to further enhance the attraction between the takedown tool 10 and the docking station 20 when the takedown tool is seated on the docking station 20. The magnetic material can be a rare-earth neodymium type material. The magnet can be glued, epoxied, or otherwise secured in place.

To install the takedown tool and docking station assembly on a firearm, the collapsible buttstock of the firearm is removed from the receiver extension and the docking station is slid over the receiver extension. The docking station is secured to receiver extension by tightening the fastener element. The takedown tool can then be removeably secured to the docking station by merit of the magnetic communication between the magnet of the takedown tool and the magnetic material of the docking station. The buttstock is then reinstalled to the receiver extension.

Also provided is a takedown tool and docking station assembly configured for placement on the rail assembly of a firearm. For the AR-15 or similar type model firearm, Picatinny rail type features can be used to hold a scope or other accessory. Exemplary rail-type mounting assemblies are described in U.S. Pat. No. 8,333,137, U.S. Pat. No. 8,276,304, and U.S. Pat. No. 8,087,194, the relevant portions of which are hereby incorporated by reference. The Picatinny mounting rail is typically placed in a parallel orientation to a weapon's receiver or barrel, or can be incorporated into a long arm's stock or a pistol frame. Accessories are typically clamped or attached to the rail by a combination of rigid and clamping members, affixed by screws, bolts, thumbscrews and/or cam levers that index into transverse slots that repeat for the length of the rail at a precise uniform spacing.

A Picatinny rail (MIL-STD-1913), which is also sometimes called a tactical rail, is a standard bracket that is used on some firearms that provides a standardized mounting platform for accessories. Picatinny rails are used on many different types of firearms and were originally designed for mounting scopes. However, the rails are useful for mounting any number of different types of accessories, including but not limited to accessories such as optics, sighting telescopes, laser aiming modules, thermal imaging devices, night vision devises, knives, cameras, flashlights, foregrips, bipods, bayonets, and the like. The rail is a longitudinal member that is mounted to the weapon. The rail includes opposed side edges with a specific configuration and a series of ridges extending transverse to the longitudinal axis of the member; each ridge is separated from adjacent ridges with a spacing slot. The rails typically have very standardized size and spacing specifications.

There are numerous ways to mount a Picatinny rail to a firearm, depending to an extent on the specific firearm and stock. In many cases, the Picatinny rail is an integral and standard part of the firearm that is added by the manufacturer. Moreover, regardless of the manner of attachment, one or more Picatinny rails may be mounted to a firearm. For instance, three and sometimes four rails may be mounted at approximately 90 degree positions around the barrel and stock. Generally speaking, the Picatinny rail provides a very stable mounting platform that tends to dissipate heat as the barrel heats and cools, and therefore tends to not flex.

Figure 6:
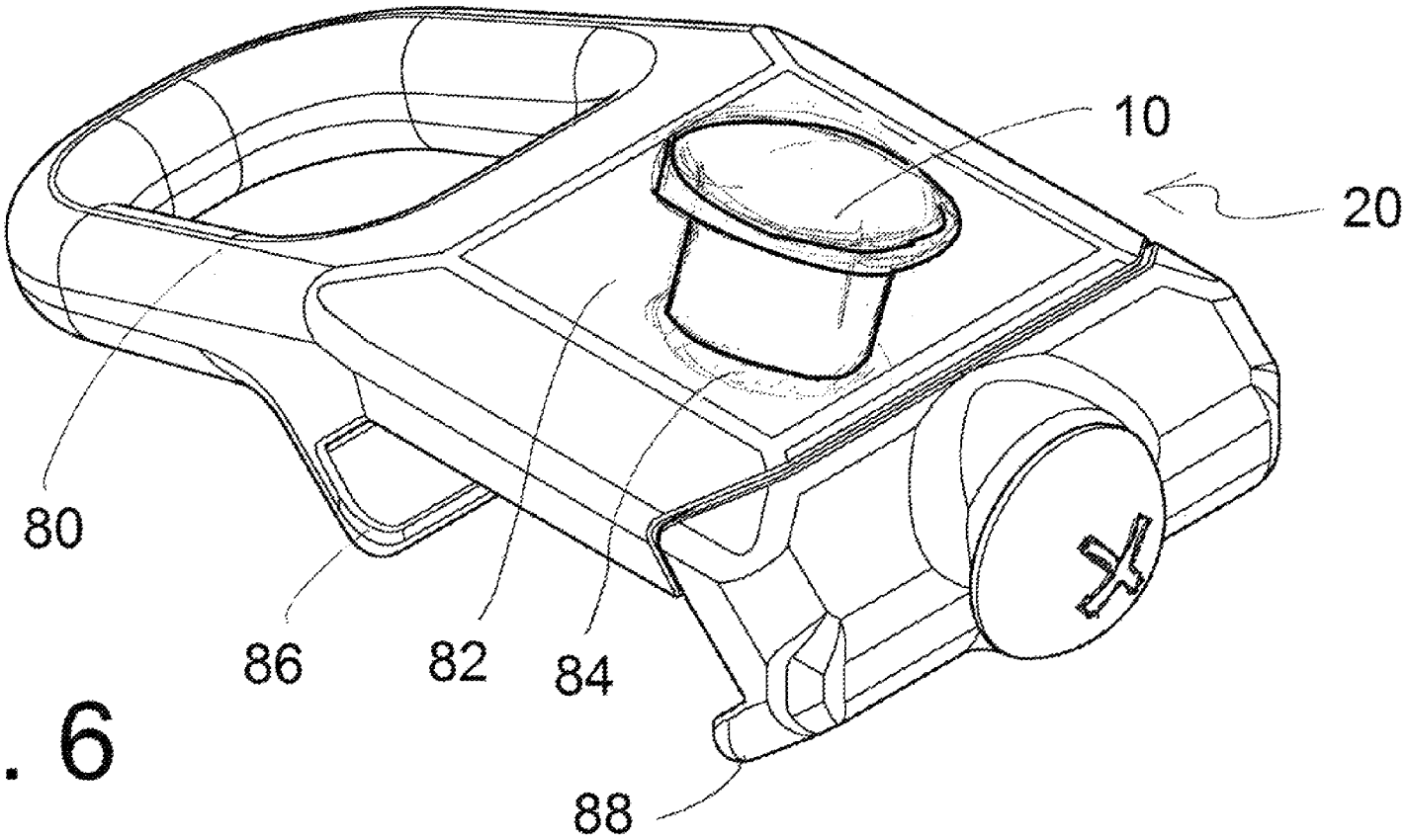
FIG. 6 is a top rear perspective view of a rail-mounted takedown tool and docking station assembly adapted to be removably attached to a rail assembly.

FIG. 6 illustrates a takedown tool and docking station assembly 20 adapted to be removably attached to a rail assembly. The takedown tool 10 is as described above with reference to FIGS. 1A-5. The docking station assembly 20 is configured similarly to the rail-mounted sling adapter described and claimed in U.S. D636836, which is hereby incorporated by reference. More particularly, the docking station assembly has a clip design. The docking station assembly spans the width of the rail and attaches to the opposed longitudinal edges of the rail via a securing mechanism that locates the docking station relative to the transverse ridges of the rail. The docking station also includes a securing system by which the docking station is secured to the rail.

The docking station can also include a sling adapter 80 in certain aspects of the invention. In other aspects, the docking station does not include a sling adapter. As was described above, the docking station 20 is comprised of a metal which is attractive to a magnet. Suitable metals include aluminum and/or steel. As illustrated in FIG. 6, the docking station comprises a relatively flat outer surface 82 having a magnetic charge. Disposed within the outer surface 82 of the docking station is a recessed portion 84. The recessed portion 84 can house a takedown tool 10, which attaches to the recessed portion by merit of magnetic attraction. On the inner surface (not shown) of the docking station 20, there is a substantially flat midsection flanked by a pair of clip arms 86, 88. The clip arms 86, 88 extend from the substantially flat surface and taper inward such that the clip arms 86 and 88 engage with the picatinny rail and secure the docking station assembly to the rail.

Figure 7:
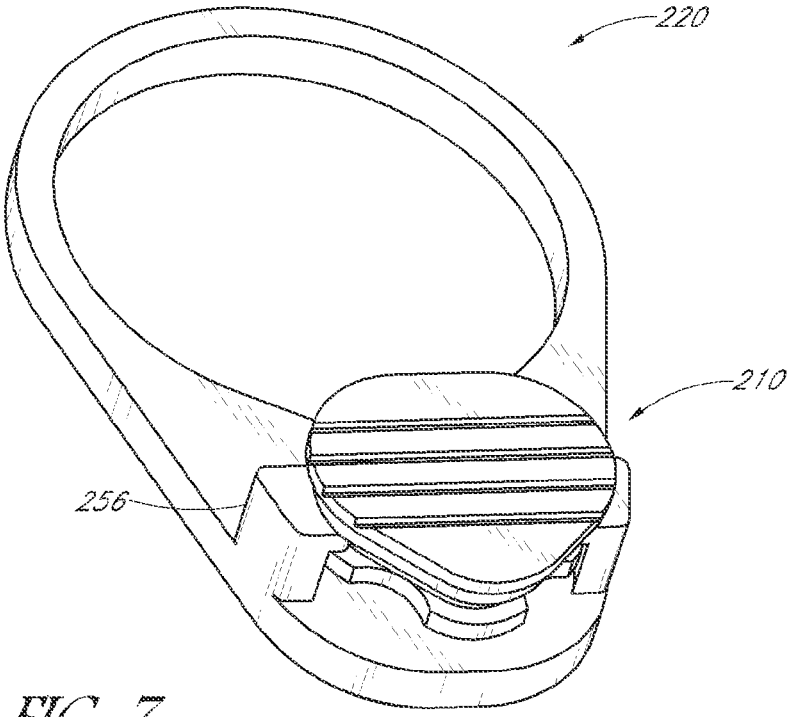
FIG. 7 is a front perspective view of another embodiment of a tool and docking station in an assembled configuration incorporating the design of the present invention.
Figure 8:
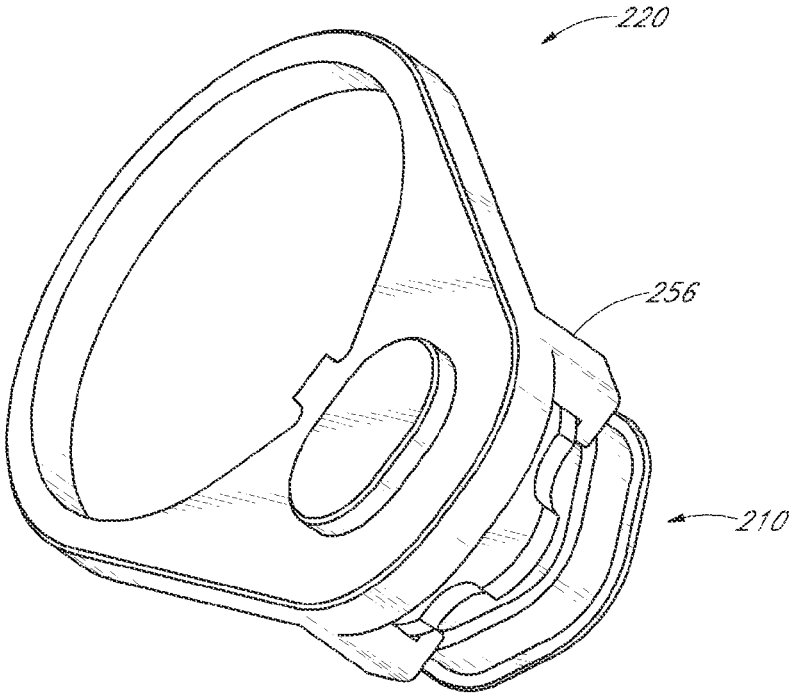
FIG. 8 is a back perspective view of the assembly of FIG. 7.
Figure 11:
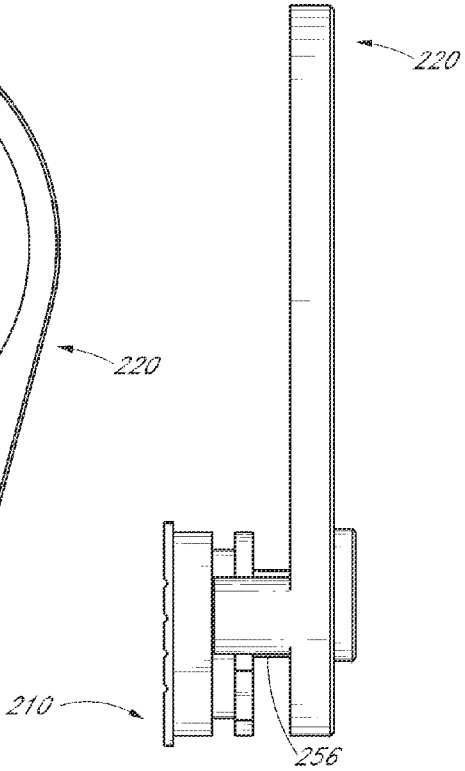
FIG. 11 is a right side view of the assembly of FIG. 7.
Figure 10:
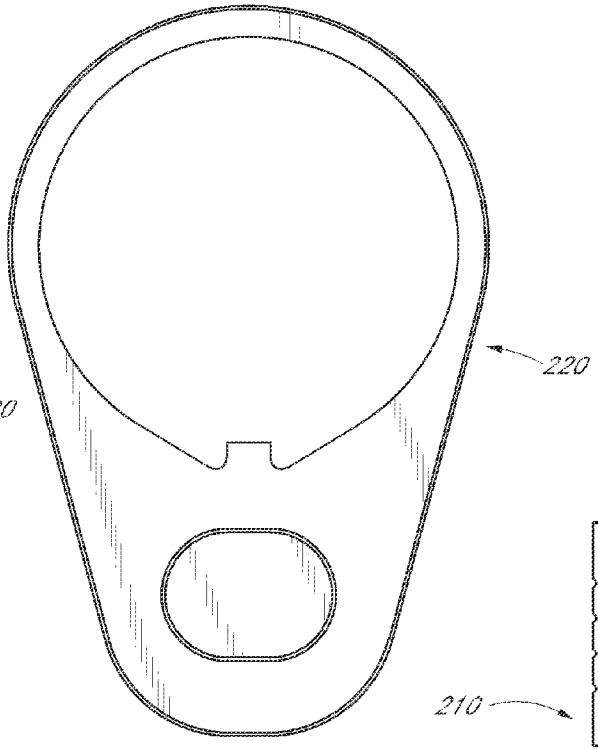
FIG. 10 is a back view of the assembly of FIG. 7.
Figure 9:
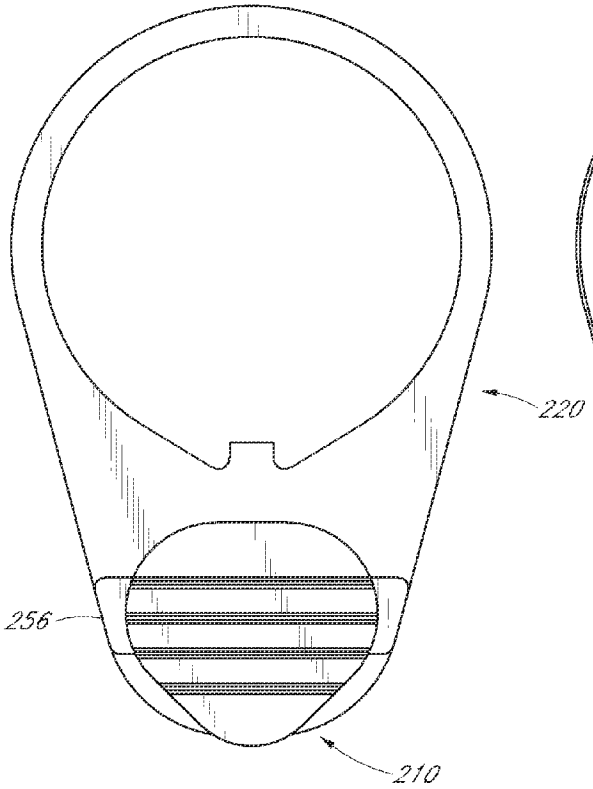
FIG. 9 is a front view of the assembly of FIG. 7.
Figure 12:
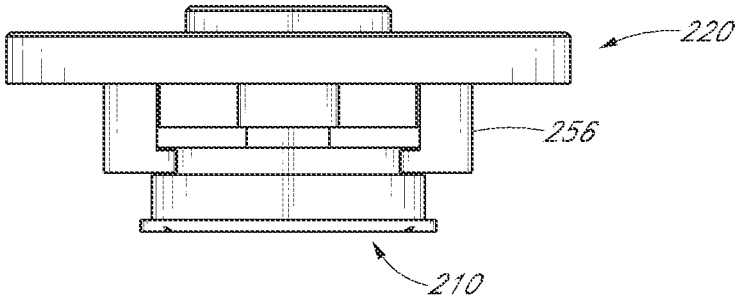
FIG. 12 is a top view of the assembly of FIG. 7.
Figure 13:
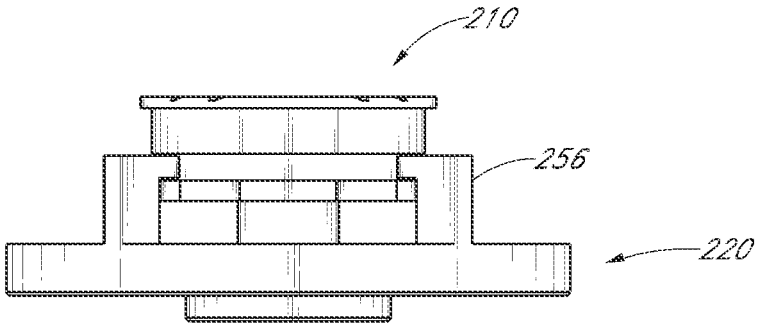
FIG. 13 is a bottom view of the assembly of FIG. 7.

FIG. 7 illustrates another embodiment of an assembly that includes a takedown assist tool 210 and docking station 220. In FIG. 7, the takedown assist tool 210 is seated in the docking station 220. In certain embodiments, the takedown assist tool 210 has similar magnetic properties to the takedown assist tool 10 illustrated in FIGS. 1A and 1B.

Figure 14:
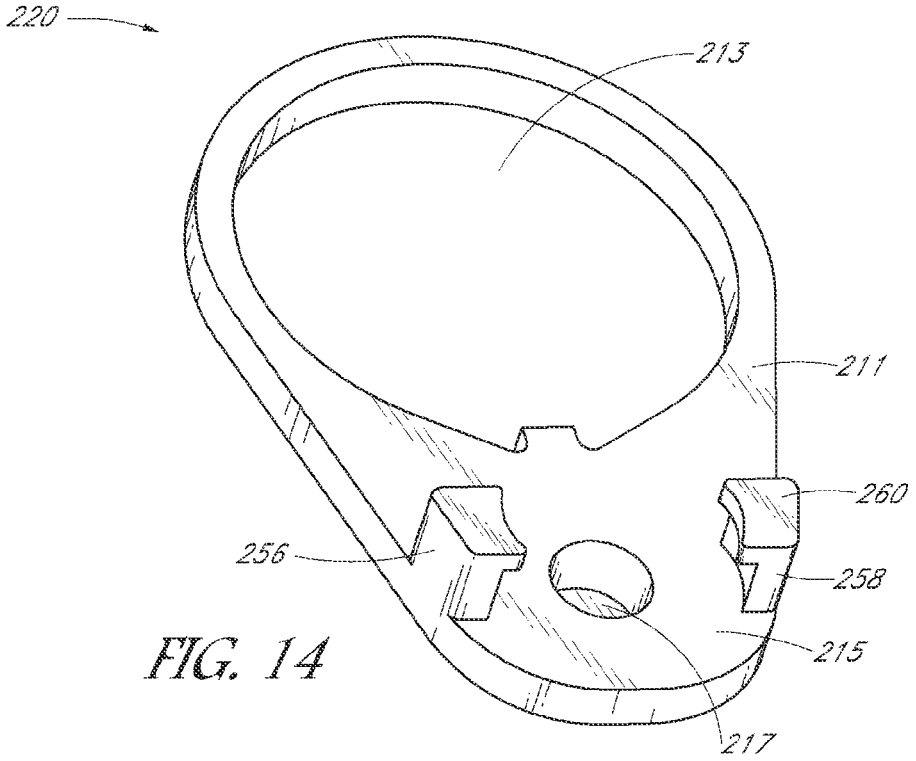
FIG. 14 is a front perspective view of the docking station in FIG. 7 with the tool removed.

Advantageously, the docking station 220 comprises one or more features for releasably securing the takedown tool 210 to the docking station 220. In this way, certain embodiments of the docking station 220 include multiple or redundant structures for attaching the tool 210 to the docking station 220. For example as illustrated in FIG. 14, the docking station 220 may include a recessed portion configured to engage or seat the takedown tool 210. As described more fully below, the tool 210 and the recessed portion may rely on a press-fit or interference fit, magnetism, screw thread, adhesive, and/or the like to secure the tool to the recessed portion. In certain embodiments which rely on magnetism, the takedown tool 210 can be in magnetic communication with the recessed portion of the docking station 220 and removeably attached to the docking station 220 via a magnetic attraction.

Separately from or in addition to the engagement between the tool 210 and the recessed portion, the docking station 220 may include one or more protrusions, ridges, arms, tangs, straps, clips, and/or the like to releasably secure the tool 210 to the docking station 220 independent of the engagement between the tool 210 and the recessed portion. For example as more fully described below, the docking station 220 may include one or more protrusions which engage, contact, abut, or hook to a corresponding recess, groove, surface feature, and/or the like of the tool 210 to releasably secure the tool 210 to the docking station 220. In such an exemplary embodiment, the tool 210 can engage with the docking station 220 via magnetism and also engage with the docking station 220 via one or more protrusions. Of course the assembly need not include more than one feature for releasably securing the takedown tool 210 to the docking station 220.

In embodiments which include more than one feature for releasably securing the tool 210 to the docking station 220, the features need not be disposed on the same portion of the tool 210 or the docking station 220. For example, the tool 210 can engage with the docking station 220 within the recessed portion while also engaging with the docking station 220 at the same or different location(s) on the docking station 220 using threads or other structure. For example, the threads could be located on the outer surface of the portion of the tool 210 or body portion inserted into the recessed portion of the docking station 220 or on a head portion of the tool 210 for engagement with a projection from the docking station 220.

Preferably for magnetic embodiments, the docking station 220 is fabricated from a metal which is attractive to the neodymium material of the takedown tool 210. Takedown assist tool 210 is self-sustaining in place relative to the docking station 220 by virtue of magnetic communication between the takedown assist tool 210 and the docking station 220. In addition, the embodiment illustrated in FIG. 7 includes a second feature for securing the tool 210 to the docking station 220. The docking station 220 and tool 210 can include one or more engagement structures which redundantly secure the tool 210 in place. For example, the assembly illustrated in FIG. 7 includes a secondary securement 256 in the form of one or more tangs and one or more grooves which receive the one or more tangs.

FIGS. 8 through 13 illustrate other views of the docking station 220 engaged with the takedown assist tool 210. The docking station 220 is shown disengaged from the takedown assist tool 210 in FIGS. 14 through 20, and will be described in more detail below. The takedown assist tool 210 is shown disengaged from the docking station 220 in FIGS. 21 through 27, and will be described in more detail below.

The docking station 220 is generally secured to the rifle near the rifle's receiver as shown for docking station 20 in FIGS. 2A and 2B. As described above for docking station 20, the docking station 220 attaches to the rifle 70 near or adjacent to the rifle's end plate 72, between the buttstock assembly 74 and the buffer tube 76. While the docking station and tool assembly are preferably attached to a firearm at the end plate, it will be appreciated that the tool and docking assembly can be affixed to other parts of a firearm to provide ease of access for takedown of the firearm as described above for docking station 20 and tool 10. In certain embodiments, the docking station 220 and takedown tool 210 weigh about 4 oz.

As illustrated in FIG. 14, the docking station 220 generally comprises a main fitting body 211 having an aperture 213 configured to allow passage of a receiver extension of a firearm through the aperture 213. As illustrated in FIG. 14, the main fitting body 211 has an ovular shape with a portion of the main body 211 defining the aperture 213 through which a receiver extension will slide when the docking station 220 is installed on a firearm. A wider portion 215 of the main fitting body 211 provides a docking area for a takedown tool 210.

The docking area can include a recessed area 217. The recessed area 217 can be dimensioned to seat the takedown tool 210 on the surface of the docking area. As illustrated in FIG. 14, the docking station 220 further comprises one or more secondary securements 256. These securements 256 can be in the form of one or more protrusions, ridges, arms, tangs, straps, clips, and/or the like to releasably secure the tool 210 to the docking station 220 independent of the engagement between the tool 210 and the recessed area 217. For example, the docking station 220 may include one or more protrusions which engage, contact, abut, or hook to a corresponding recess, groove, surface feature, and/or the like of the tool 210 to releasably secure the tool 210 to the docking station 220. In such an exemplary embodiment, the tool 210 can engage with the docking station 220 via magnetism and also engage with the docking station 220 via one or more protrusions. Of course the assembly need not include more than one feature for releasably securing the takedown tool 210 to the docking station 220.

In the embodiment illustrated in FIG. 14, the securement 256 comprises a hook. Of course the secondary securement 256 need not be in the shape of a hook and could have a different structure by which the tool 210 is secured to the docking station 220. The secondary securement 256 includes element 258 and element 260. Of course the secondary securement 256 need not include multiple elements to engage with the tool 210 nor do the elements have to have a specific size or shape to provide securement between the tool 210 and the docking station 220.

In the illustrated embodiment, the element 258 extends upward at approximately a 90° angle relative to the front surface of the docking station 220. The top of the element 258 is coupled to the element 260. In the illustrated embodiment, at least a portion of the element 260 is substantially parallel to the wider portion 215 of the docking station 220. The horizontal element 260 is coupled to the upper portion of the vertical element 258 and is dimensioned such that the horizontal element 260 can slide into a groove, recess, thread, or track 290 on the takedown assist tool 210. The horizontal element 260 provides further protection from inadvertent dislodgement of the takedown tool 210 from the docking station 220 if the firearm is dropped or otherwise disrupted by further holding the takedown tool 210 in place.

In embodiments where the docking station 220 is constructed from metals which attract a magnet, the takedown tool 210, which in certain embodiments is at least partially constructed from magnetic material, attracts to the docking station 220. Thus, the takedown tool 210 can be removeably attached to the docking station 220.

In one aspect, the docking station 220 may also include magnetic material at the recessed portion 217 to further enhance the attraction between the takedown tool 210 and the docking station 220 when the takedown tool is seated on the docking station 220. The magnetic material can be a rare-earth neodymium type material. The magnet can be glued, epoxied, or otherwise secured in place.

Figure 15:
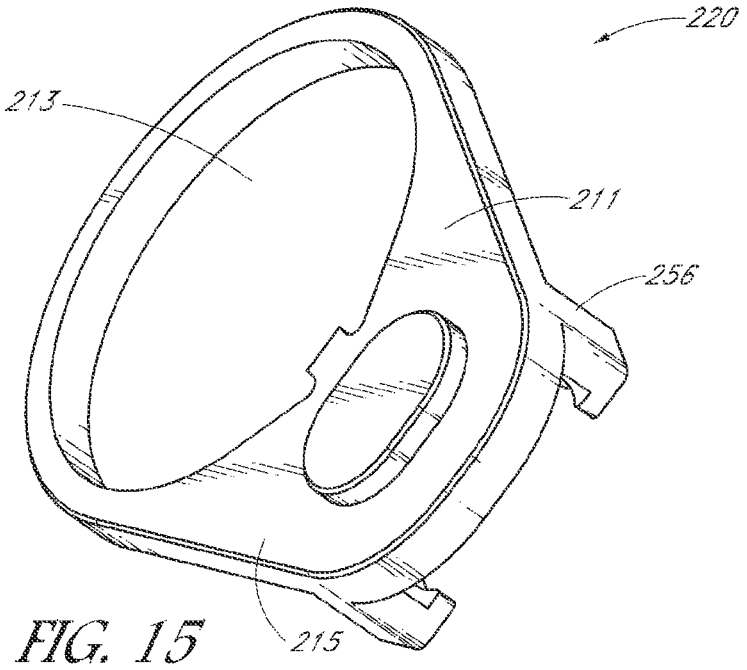
FIG. 15 is a back perspective view of the docking station from FIG. 14.
Figure 18:
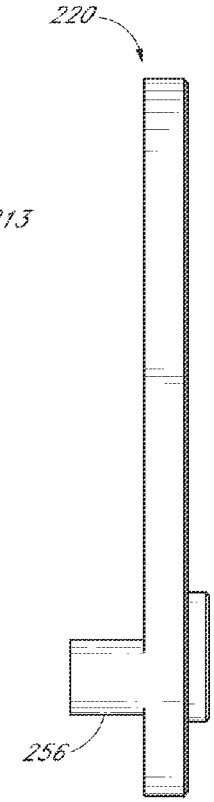
FIG. 18 is a right side view of the docking station from FIG. 14.
Figure 17:
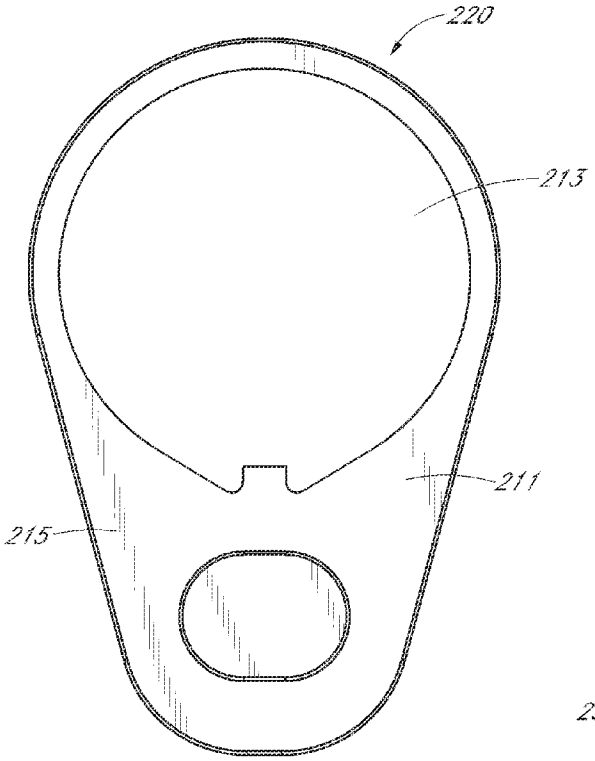
FIG. 17 is a back view of the docking station from FIG. 14.
Figure 16:
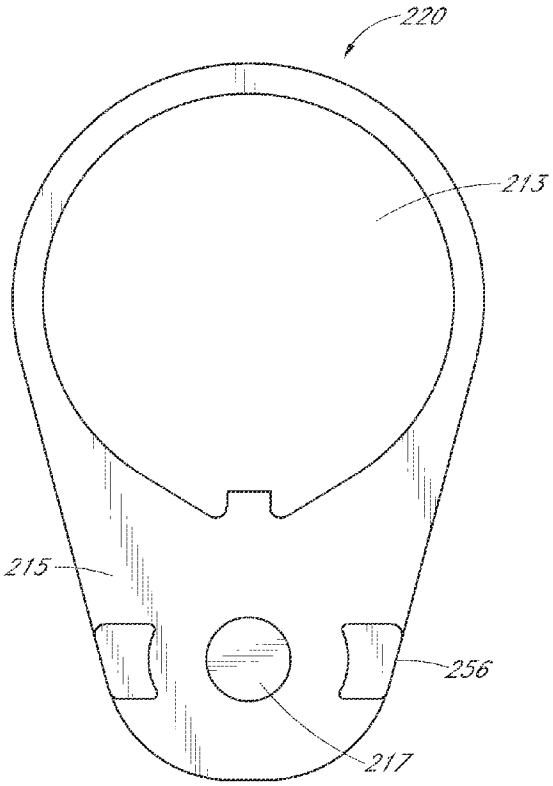
FIG. 16 is a front view of the docking station from FIG. 14.
Figure 19:
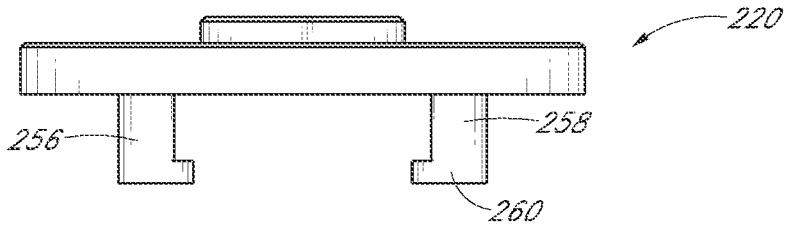
FIG. 19 is a top view of the docking station from FIG. 14.
Figure 20:
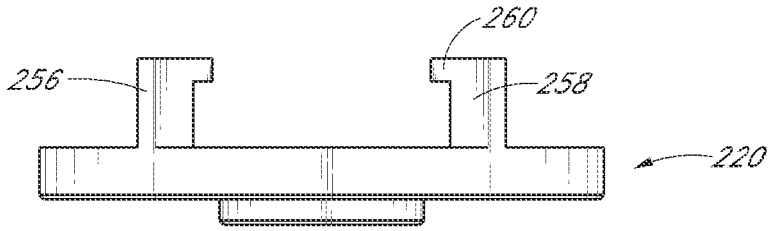
FIG. 20 is a bottom view of the docking station from FIG. 14.

FIGS. 15 through 20 illustrate additional views of the docking station 220. FIG. 15 is a back perspective view of the docking station 220 from FIG. 14. FIG. 16 is a front view of the docking station 220 from FIG. 14. FIG. 17 is a back view of the docking station 220 from FIG. 14. FIG. 18 is a right side view of the docking station 220 from FIG. 14. FIG. 19 is a top view of the docking station 220 from FIG. 14. FIG. 20 is a bottom view of the docking station 220 from FIG. 14.

Figure 21:
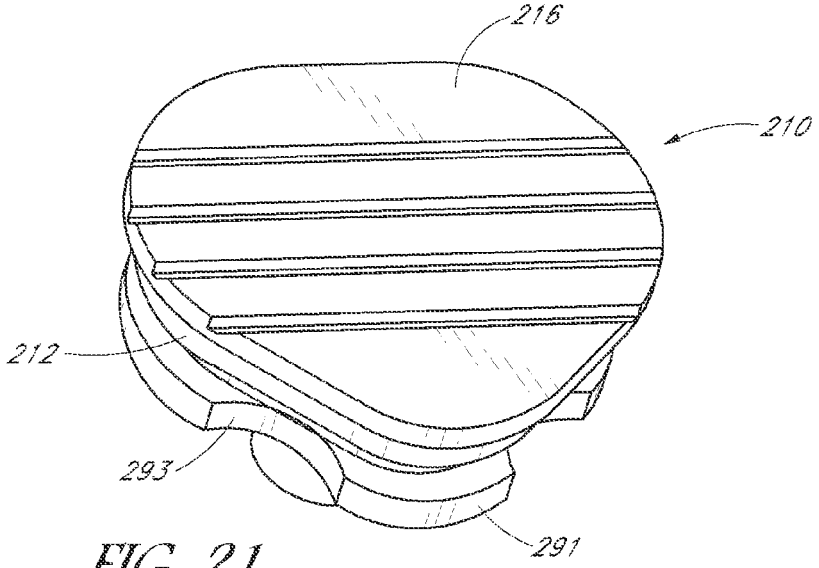
FIG. 21 is a front perspective view of the tool in FIG. 7 removed from the docking station.
Figure 22:
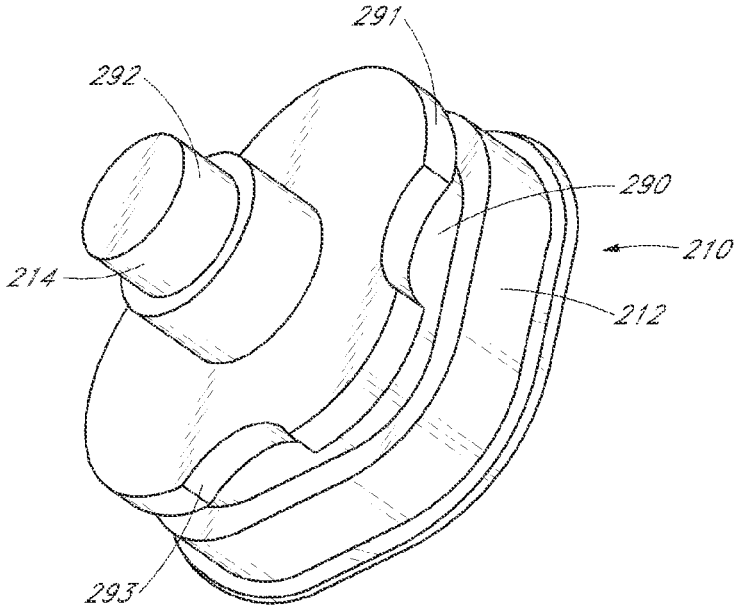
FIG. 22 is a back perspective view of the tool from FIG. 21.
Figure 25:
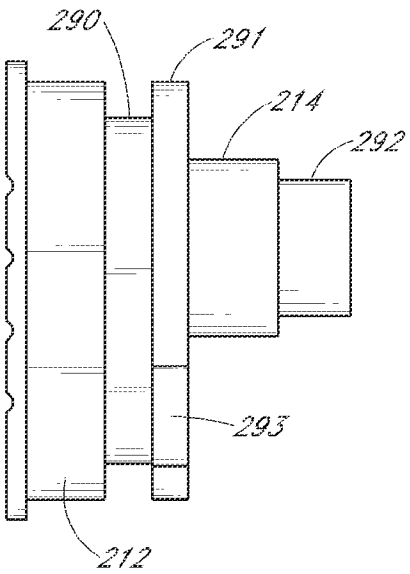
FIG. 25 is a right side view of the tool from FIG. 21.
Figure 24:
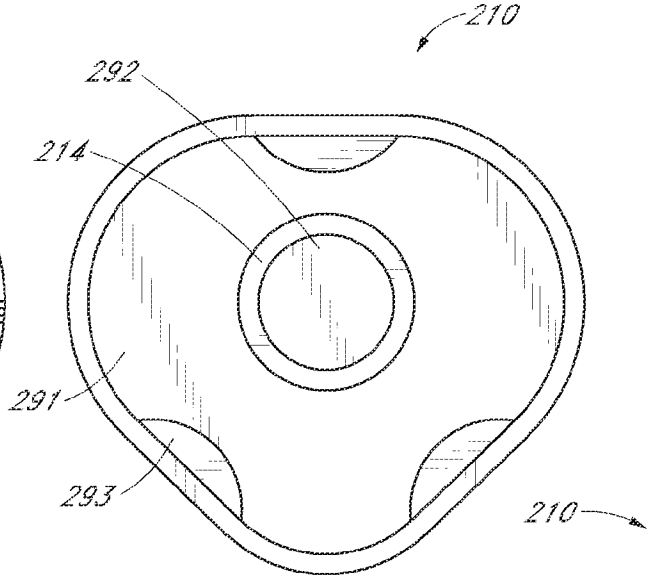
FIG. 24 is a back view of the tool from FIG. 21.
Figure 23:
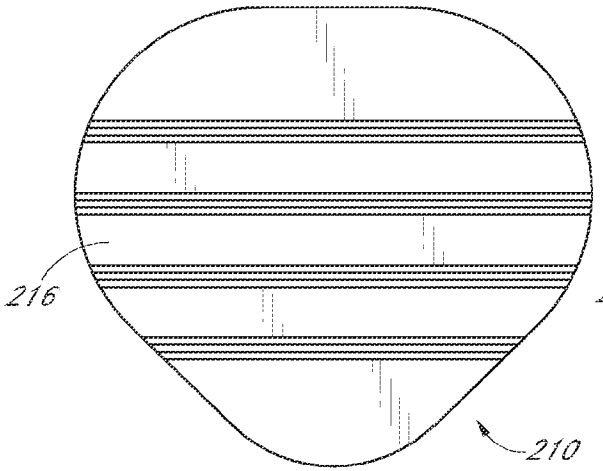
FIG. 23 is a front view of the tool from FIG. 21.
Figure 26:
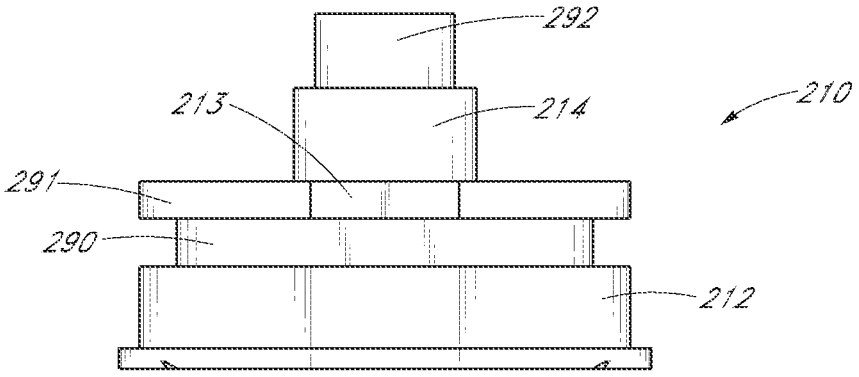
FIG. 26 is a top view of the tool from FIG. 21.
Figure 27:
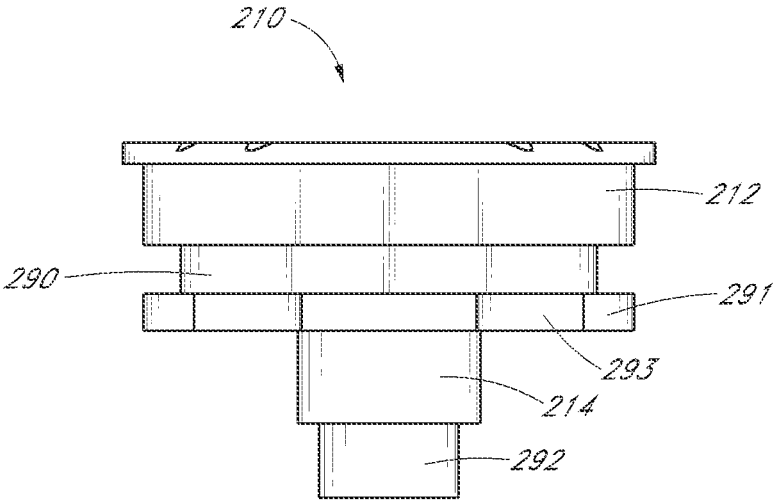
FIG. 27 is a bottom view of the tool from FIG. 21.

FIGS. 21 and 22 illustrate the takedown assist tool 210 disengaged from the docking station 220. The takedown assist tool 210 comprises a body portion 214 and a head portion 216. The tool 210 may further comprise a groove, recess, thread, or track 290, a flange 291, and/or a magnetic element 292. The magnetic element 292 is disposed within the body portion 214. The magnetic element can be pressure fitted to the body portion 214, affixed by an epoxy, slip fitted, or otherwise adhere to the center core of the body portion 214. The magnetic element is preferably constructed from a powerful rare-earth magnetic material 'neodymium', which is metal-like in appearance, and as such serves to aid the seating of the tool into the center recess of the docking station.

The head portion 216 comprises a flange 212 extending outward from the body portion 214. In operation, the flange 212 provides a lip to facilitate grasping and/or removing of the tool 210 from the docking station 220 and insertion of the tool 210 into the takedown pins of a rifle. The flange 212 further defines an upper boundary for the track 290. Though not illustrated, it will be appreciated that the head portion 216 can optionally include a layer of plastic, rubber, texture, or other suitable material to provide added grip to the head portion 216.

The track 290 is dimensioned such that the securement 256 can slide into place to further secure the tool 210 relative to the docking station 220. The flange 291 can serve as a lower track boundary for the track 290. Thus, the flanges 291, 212 can form upper and lower boundaries for the track 290.

The flange 291 can include one or more recesses 293 in an outer circumference of the flange 291. The recesses 293 are dimensioned such that the element(s) 260 of the securement(s) 256 can pass through the recesses 293 to enter the track 290. In operation, one or more of the recesses 293 can be aligned with the elements 260 to facilitate disengagement of the tool 210 from the docking station 220. In certain embodiments, the tool 210 is rotated relative to the docking station 220 to disengage one of the elements 260 from the track 290 by aligning the element 260 with one of the recesses 293. Once aligned, one of the elements 260 is disengaged from the tool 210. The tool 210 is then further rotated until another one of the elements 260 can be disengaged from the track 290 by aligning the element 260 with another one of the recesses 293. Once aligned, the second element 260 is disengaged from the tool 210. For embodiments with only two additional securements 256 as is illustrated in FIG. 7, the tool 210 can then be entirely removed from the docking station 220.

The takedown tool 210 is dimensioned to fit within the takedown pins of a rifle. In some embodiments, the takedown tool 210 has a radius of between about ⅛" and ¼". FIGS. 23 through 27 illustrate other views of the takedown assist tool 210.

Figure 28:
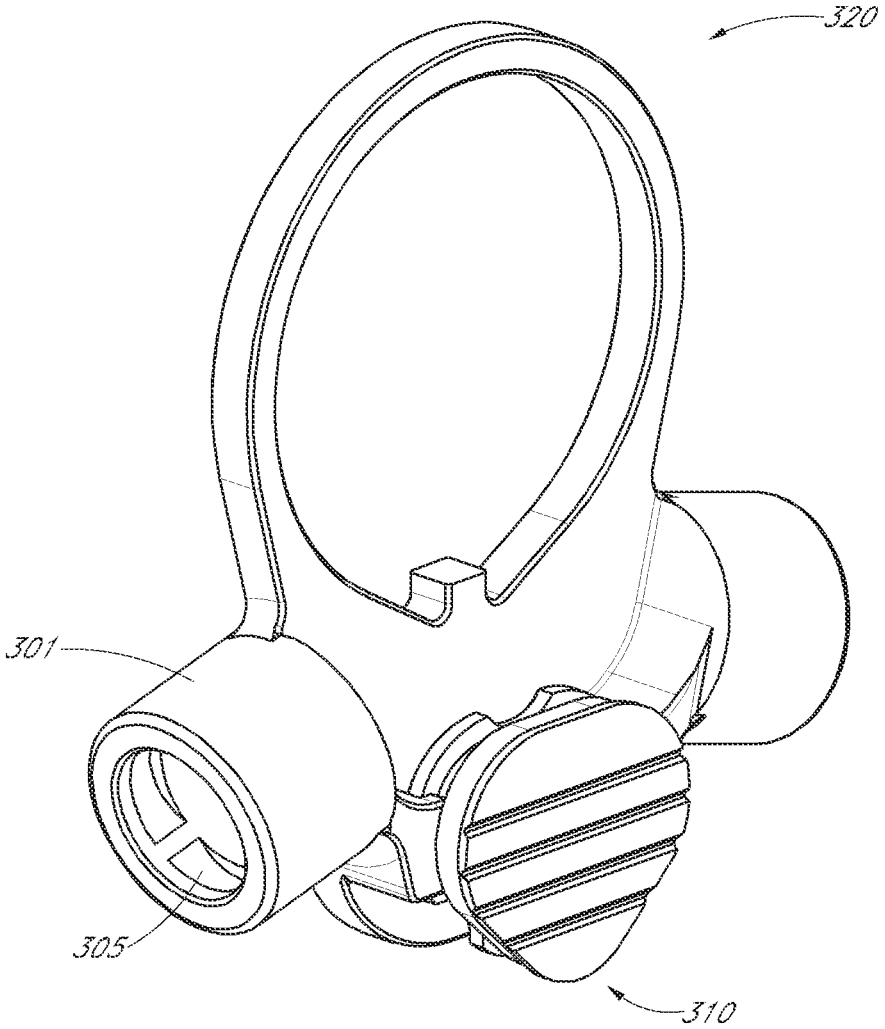
FIG. 28 is a front perspective view of another embodiment of an assembly.

FIG. 28 illustrates another embodiment of a takedown assist tool 310 seated in a docking station 320. The takedown assist tool 310 is substantially similar to the takedown assist tool 210 shown in FIG. 7. The docking station 320 is similar to the docking station 220 from FIG. 7 except that the docking station 320 includes one or more securement receptacles 301. The one or more securements 301 may serve as attachment points for additional devices such as slings and the like. In certain embodiments, the one or more receptacles 301 are configured to receive a sling swivel 302. In certain embodiments the one or more receptacles 301 include one or more recesses 305.

Figure 29:
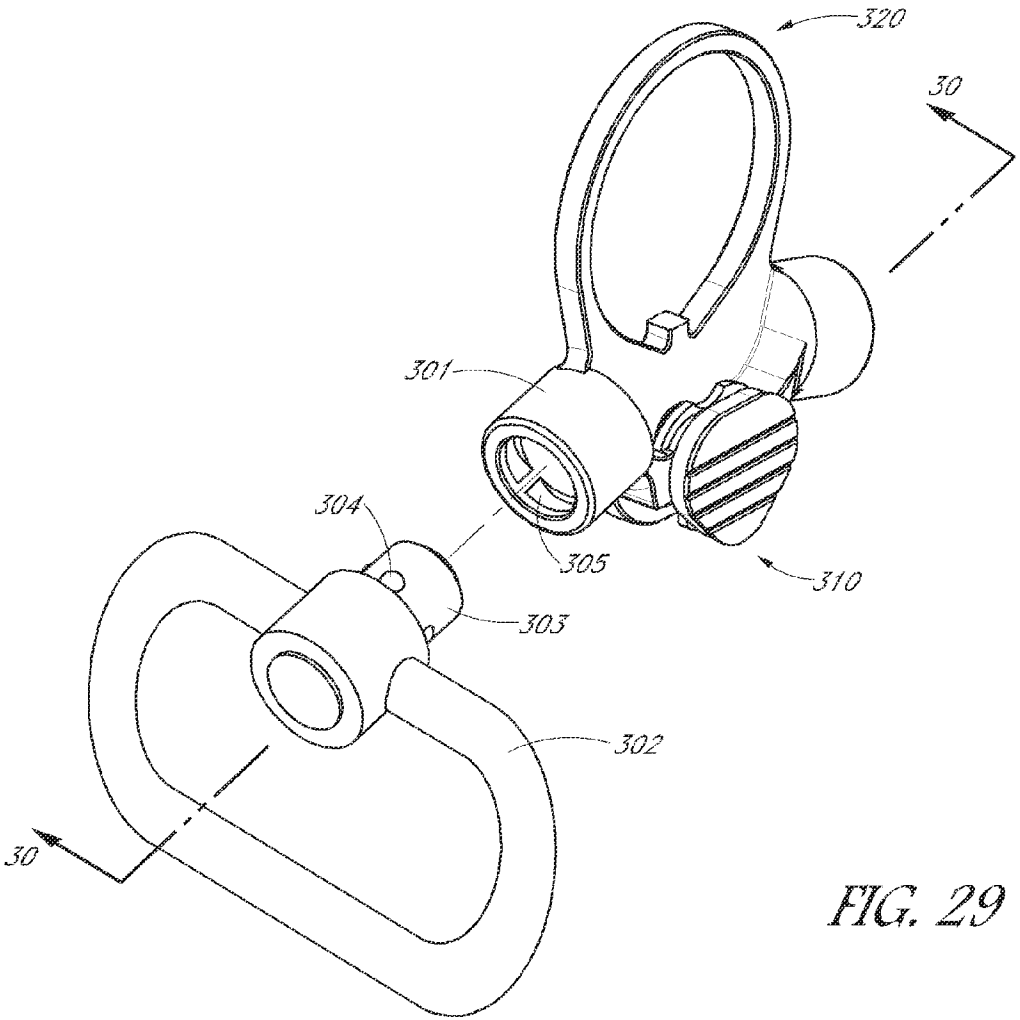
FIG. 29 is a front perspective view of the assembly from FIG. 28.
Figure 30:
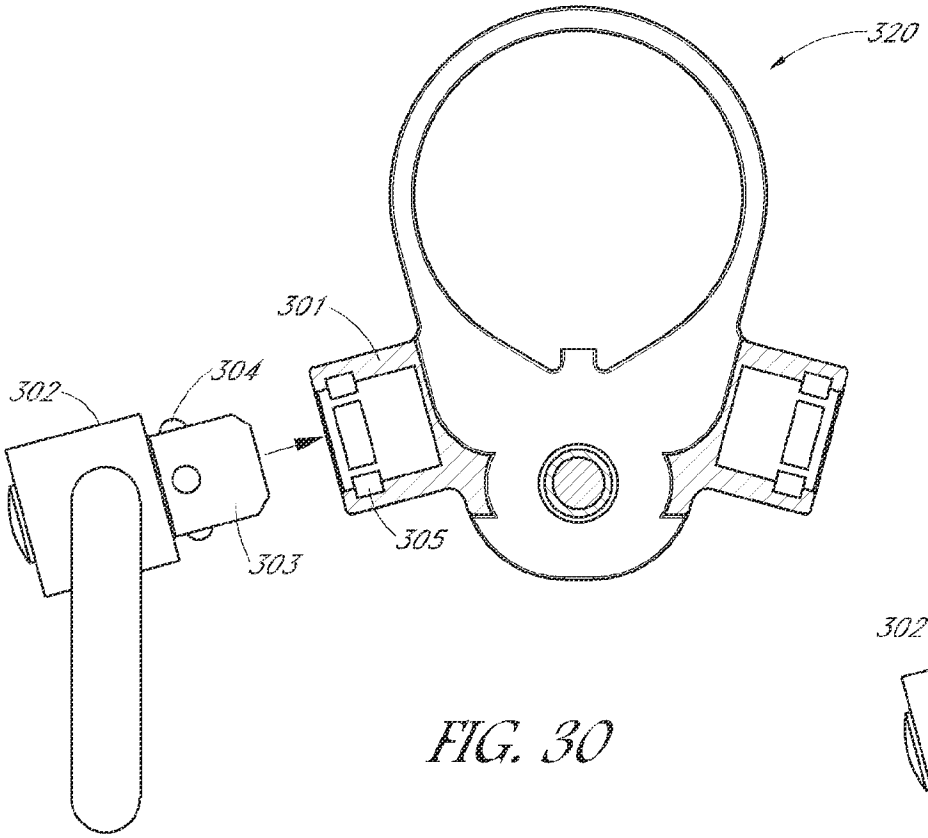
FIG. 30 is a cross-section view through the assembly in FIG. 29 along line 30-30.

FIG. 29 is a front perspective view of the takedown assist tool 310 and docking station 320 from FIG. 28 with a sling swivel 302 aligned with one of the securement receptacles 301 prior to attachment to the docking station 320. As illustrated in FIG. 30, the sling swivel 302 includes a shaft 303. The shaft 303 includes one or more retractable radial bearings 304. The receptacles 301 are dimensioned such that the shaft 303 can be inserted into the receptacles 301 when the retractable radial bearings 304 are in the retracted state. The radial bearings 304 are retracted when a user presses a button on the end of the shaft 303 near the swivel 302. The recesses 305 are dimensioned such that the retractable radial bearings 304 can engage the recesses 305 when in the non-retracted state to prevent removal of the shaft 303 from the receptacle 301.

Figure 31:
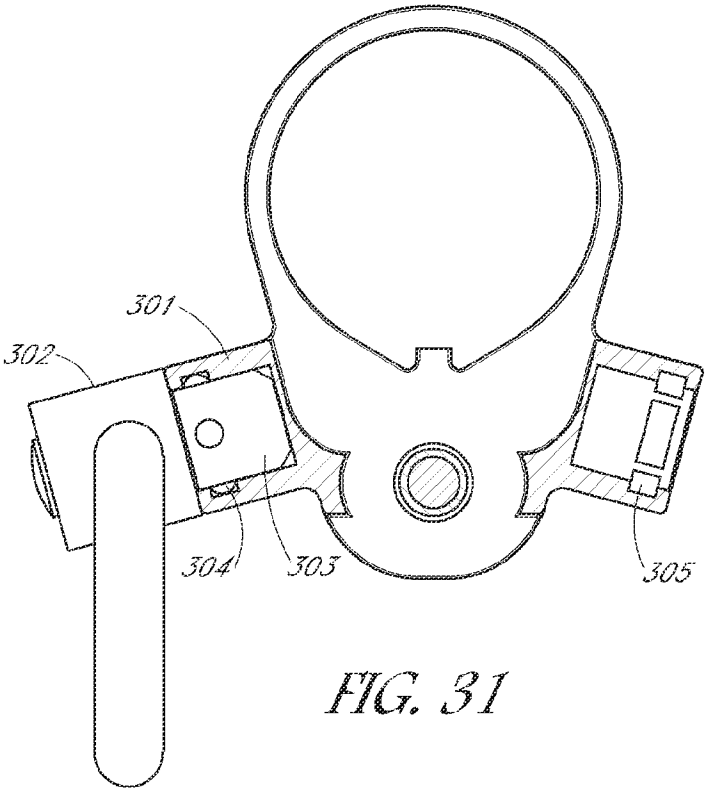
FIG. 31 is a cross-section view similar to FIG. 30.

FIG. 30 is a cross-section view through the docking station 320 in FIG. 29 along line 30-30. FIG. 31 illustrates a cross-section view similar to FIG. 30 in which the shaft 303 of the sling swivel 302 is disposed in the receptacle 301 with the bearings 304 engaged with the recesses 305. In operation, the shaft 303 is inserted into the securement receptacle 301 when the radial bearings 304 are in the retracted state. The radial bearings 304 are then released to the non-retracted state and engage the recesses 305, securing the sling swivel 302 to the docking station 320. The recesses 305 can be dimensioned to allow for some rotational movement of sling swivel 302 when secured in docking station 320. In operation, docking station 320 allows for attachment of a rifle sling to the left side or right side of a rifle, and in some embodiments, the center below the tactical takedown tool 310.

Figure 32:
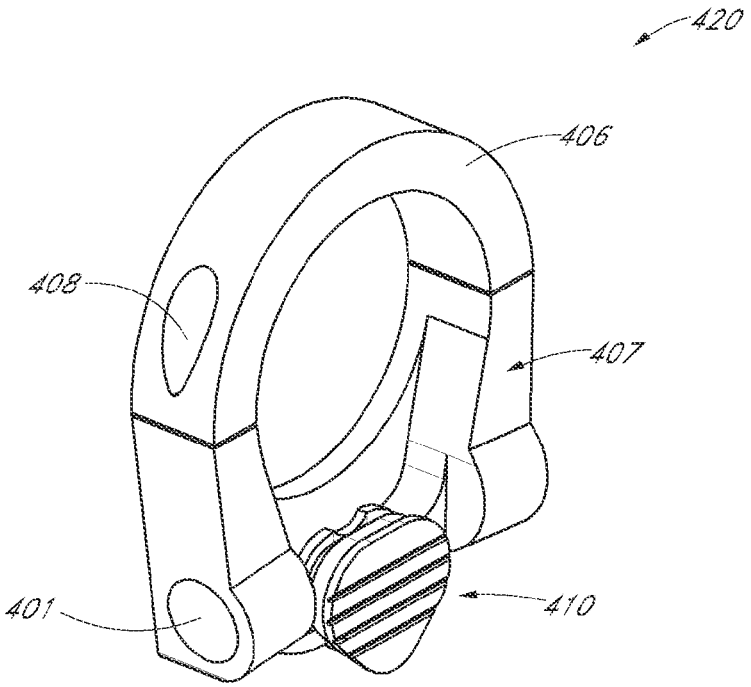
FIG. 32 is a front perspective view of another embodiment of an assembly.

FIG. 32 illustrates another embodiment of a takedown assist tool 410 seated in a docking station 420. Takedown assist tool 410 is substantially similar to takedown assist tool 210 shown in FIG. 7. The docking station 420 is similar to the docking station 320 from FIG. 28 except that the docking station 420 is comprised of more than one piece. In such an embodiment, the docking station 420 can be assembled with one or more fasteners around a portion of the firearm such as a castle nut. Similar to the docking station 320, the docking station 420 includes one or more securement receptacles 401 to releasably receive a sling swivel or the like.

Figure 33:
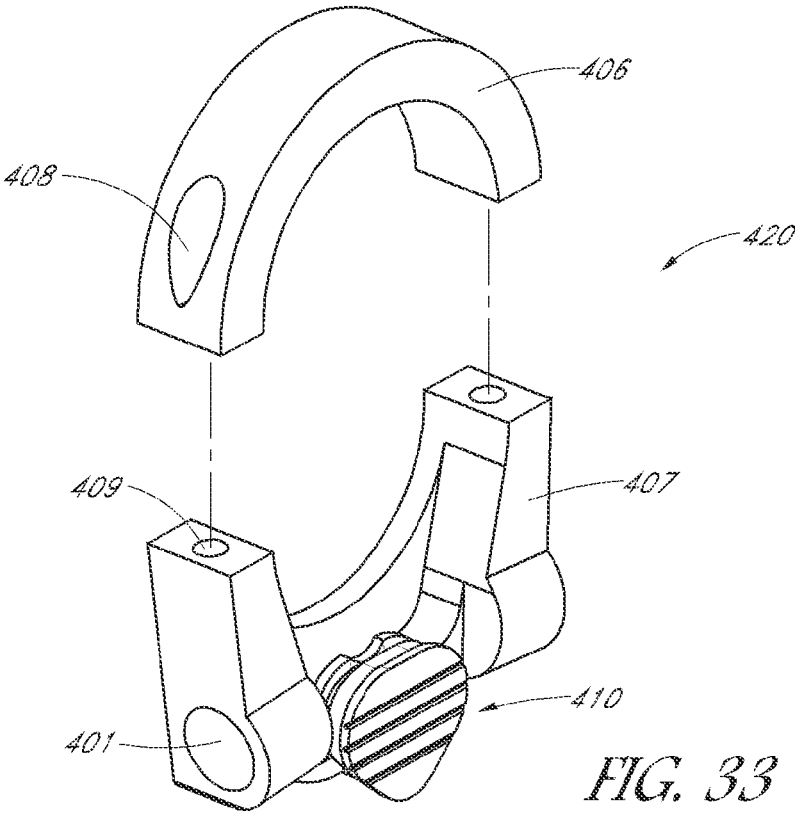
FIG. 33 is a front perspective view of the assembly from FIG. 32.

The docking station 420 comprises an upper portion 406 and a lower portion 407. FIG. 32 illustrates the docking station 420 with the upper portion 406 engaged with the lower portion 407. FIG. 33 illustrates the docking station 420 with the upper portion 406 disengaged from the lower portion 407.

In certain embodiments, the docking station 420 includes one or more fasteners. Fasteners can include clamping members, screws, bolts, thumbscrews and cam levers and the like. The upper portion 406 can include one or more recesses 408 while the lower portion 407 can include one or more recesses 409. The recesses 408, 409 are dimensioned such that a fastener can be inserted into the recesses 408 and engage with the recess 409. In operation, a fastener can be inserted through the recess 408 and into the recess 409 to secure the upper portion 406 to the lower portion 407. In operation, the two portion design allows the docking station 420 to be attached near and over a castle nut and/or buffer tube such as buffer tube 76 illustrated in FIG. 2B.

Figure 36:
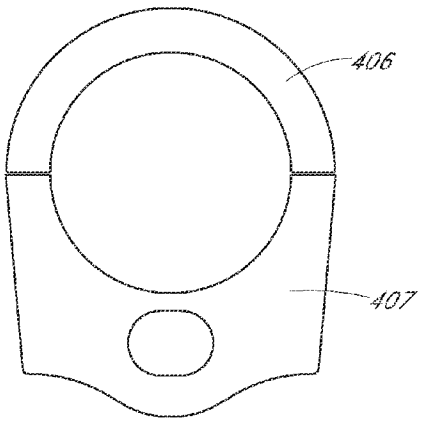
FIG. 36 is a back view of the assembly from FIG. 32.
Figure 35:
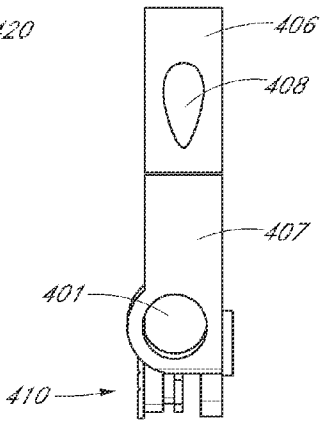
FIG. 35 is a right side view of the assembly from FIG. 32.
Figure 37:
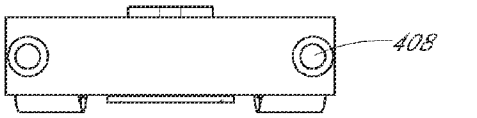
FIG. 37 is a top view of the assembly from FIG. 32.
Figure 34:
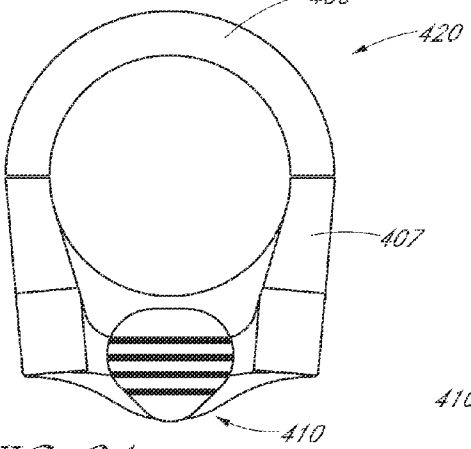
FIG. 34 is a front view of the assembly from FIG. 32.
Figure 38:
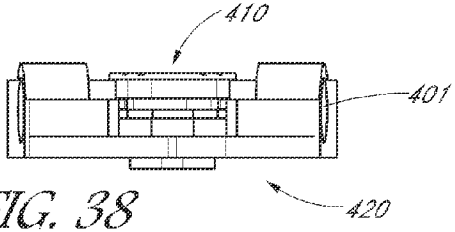
FIG. 38 is a bottom view of the assembly from FIG. 32.

FIGS. 34 through 38 illustrate other views of the takedown assist tool 410 and the docking station 420 illustrated in FIG. 32. FIG. 34 is a front view of the assembly from FIG. 32. FIG. 35 is a right side view of the assembly from FIG. 32 showing a receptacle 401 for releasably attaching a sling or the like to the docking station 420. FIG. 36 is a back view of the assembly from FIG. 32. FIG. 37 is a top view of the assembly from FIG. 32 showing one or more fasteners for attaching a portion 406 of the docking station 420 to another portion 407 of the docking station 420. FIG. 38 is a bottom view of the assembly from FIG. 32.

The above description of disclosed embodiments is provided to enable any person skilled in the art to make or use the invention. Various modifications to the embodiments will be readily apparent to those skilled in the art, the generic principles defined herein can be applied to other embodiments without departing from spirit or scope of the invention. All references cited are hereby incorporated by reference herein in their entireties and made part of this application. The invention is not intended to be limited to the embodiments shown herein but is to be accorded the widest scope consistent with the principles and novel features disclosed herein.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A firearm assembly for use in breaking down a takedown rifle comprising
   - a. A docking station
     - i. Wherein said docking station is configured to be removably secured to a takedown rifle;
     - ii. Wherein said docking station comprises
       - 1. One or more securing elements;
       - 2. A recessed area;
   - b. A magnetized takedown tool
     - i. A head portion
       - 1. Wherein said head portion has a first side and a second side opposite said second side, said first side and said second side forming a peripheral edge located between said first side and said second side;
       - 2. Wherein said peripheral edge contains one or more recessed tracks
         - a. Wherein each of said one or more recessed tracks are configured to receive one or more securing elements;
       - 3. Wherein said second side of said head portion contains one or more recesses configured to permit one or more securing elements to access said one or more recessed tracks;
     - ii. A body portion
       - 1. Wherein said body portion is connected to said second side of said head portion;
       - 2. Wherein said body portion is substantially cylindrical in shape;
       - 3. wherein the longitudinal axis of body portion extends substantially perpendicular from said head portion;
       - 4. Wherein said body portion comprises a magnetic element;
   - c. Wherein said magnetized takedown tool can be removably secured to said docking station by placing said body portion of said magnetized takedown tool within said recessed area of said docking station and positioning said one or more securing elements of said docking station within said one or more recessed tracks of said magnetized takedown tool.

2. The assembly as in claim 1 a. Wherein said docking station further comprises a magnetic element positioned within said recessed area of said docking station.

3. The assembly as in claim 1 further comprising a. One or more sling swivels i. Wherein each of said one or more swivels comprise 1. A sling attachment;

2. A shaft connected to said sling attachment;

3. One or more bearings positioned at the base of said shaft;

b. Wherein said docking station further comprises one or more receptacles i. Wherein each of said one or more receptacles define an internal opening for receiving the shaft of said sling swivel;

ii. Wherein said internal opening comprises one or more receptacle recesses for receiving said one or more bearings on said sling swivel.

4. The assembly as in claim 1 a. Wherein said docking station further comprises a central opening defining a space to receive a buffer tube of a firearm.

5. The assembly as in claim 4 a. Wherein said docking station comprises an upper portion and a lower portion;

b. Wherein said upper portion and said lower portion may be removably secured together;

c. Wherein when said upper portion is removably secured to said lower portion, said upper portion and said lower portion define a central opening defining a space to receive a buffer tube of a firearm.

6. The assembly as in claim 4 further comprising a. One or more sling swivels i. Wherein each of said one or more swivels comprise 1. A sling attachment;

2. A shaft connected to said sling attachment;

3. One or more bearings positioned at the base of said shaft;

b. Wherein said docking station further comprises one or more receptacles i. Wherein each of said one or more receptacles define an internal opening for receiving the shaft of said sling swivel;

ii. Wherein said internal opening comprises one or more receptacle recesses for receiving said one or more bearings on said sling swivel.

7. The assembly as in claim 4 a. Wherein said docking station further comprises a magnetic element positioned within said recessed area of said docking station.

8. The assembly as in claim 5 further comprising a. One or more sling swivels i. Wherein each of said one or more swivels comprise 1. A sling attachment;

2. A shaft connected to said sling attachment;

3. One or more bearings positioned at the base of said shaft;

b. Wherein said docking station further comprises one or more receptacles i. Wherein each of said one or more receptacles define an internal opening for receiving the shaft of said sling swivel;

ii. Wherein said internal opening comprises one or more receptacle recesses for receiving said one or more bearings on said sling swivel.

9. The assembly as in claim 5 a. Wherein said docking station further comprises a magnetic element positioned within said recessed area of said docking station.

10. The assembly as in claim 8 a. Wherein said docking station further comprises a magnetic element positioned within said recessed area of said docking station.

* * * * *